US008571456B2

(12) United States Patent
Samei et al.

(10) Patent No.: US 8,571,456 B2
(45) Date of Patent: Oct. 29, 2013

(54) FIXING DEVICE AND IMAGE FORMING APPARATUS INCORPORATING SAME

(75) Inventors: Masahiro Samei, Kanagawa (JP); Yasunori Ishigaya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 178 days.

(21) Appl. No.: 13/300,013

(22) Filed: Nov. 18, 2011

(65) Prior Publication Data

US 2012/0148317 A1 Jun. 14, 2012

(30) Foreign Application Priority Data

Dec. 9, 2010 (JP) ..... 2010-275010

(51) Int. Cl.
*G03G 15/20* (2006.01)

(52) U.S. Cl.
USPC ..... 399/328; 399/67

(58) Field of Classification Search
USPC ..... 399/67, 328
See application file for complete search history.

(56) References Cited

U.S. PATENT DOCUMENTS

| | | | | |
|---|---|---|---|---|
| 6,782,216 | B2 * | 8/2004 | Suzuki | 399/69 |
| 7,369,804 | B2 * | 5/2008 | Yasuda et al. | 399/330 |
| 7,427,729 | B2 * | 9/2008 | Asakura et al. | 219/619 |
| 7,433,639 | B2 * | 10/2008 | Yasuda et al. | 399/329 |
| 7,486,923 | B2 * | 2/2009 | Imai et al. | 399/333 |
| 7,561,816 | B2 * | 7/2009 | Asakura et al. | 399/69 |
| 7,725,065 | B2 * | 5/2010 | Baba et al. | 399/328 |
| 7,912,392 | B2 | 3/2011 | Yoshinaga et al. | |
| 2002/0148828 | A1 * | 10/2002 | Nagahira | 219/619 |
| 2006/0188281 | A1 * | 8/2006 | Ota | 399/70 |
| 2006/0216080 | A1 * | 9/2006 | Nanjo | 399/333 |
| 2007/0127959 | A1 * | 6/2007 | Tatematsu et al. | 399/329 |
| 2008/0226324 | A1 * | 9/2008 | Baba et al. | 399/69 |
| 2008/0240805 | A1 * | 10/2008 | Kinouchi et al. | 399/328 |
| 2008/0285996 | A1 * | 11/2008 | Kinouchi et al. | 399/69 |
| 2009/0028617 | A1 * | 1/2009 | Katakabe et al. | 399/333 |

(Continued)

FOREIGN PATENT DOCUMENTS

| | | |
|---|---|---|
| JP | 2000-30850 | 1/2000 |
| JP | 2001-125407 | 5/2001 |
| JP | 2008-216390 | 9/2008 |
| JP | 2009-282413 | 12/2009 |

OTHER PUBLICATIONS

U.S. Appl. No. 13/298,790, filed Nov. 17, 2011, Samei, et al.

(Continued)

*Primary Examiner* — Walter L Lindsay, Jr.
*Assistant Examiner* — David Bolduc
(74) *Attorney, Agent, or Firm* — Oblon, Spivak, McClelland, Maier & Neustadt, L.L.P.

(57) ABSTRACT

A fixing device includes a switch circuit that selectively connects an alternating electric current power supply to a first exciting coil and a second exciting coil. When the switch circuit connects the alternating electric current power supply to both the first exciting coil and the second exciting coil, the first exciting coil and the second exciting coil together generate a first magnetic flux having a first density that reaches only a first heat generation layer of a fixing rotary body. When the switch circuit connects the alternating electric current power supply to the first exciting coil only, the first exciting coil generates a second magnetic flux having a second density greater than the first density that reaches both the first heat generation layer of the fixing rotary body and a second heat generation layer of a heat generator.

20 Claims, 12 Drawing Sheets

(56) References Cited

U.S. PATENT DOCUMENTS

| | | | | |
|---|---|---|---|---|
| 2009/0169232 | A1 | 7/2009 | Kunii et al. | |
| 2009/0290915 | A1* | 11/2009 | Baba | 399/329 |
| 2009/0290916 | A1* | 11/2009 | Baba | 399/329 |
| 2009/0290917 | A1* | 11/2009 | Baba et al. | 399/329 |
| 2010/0061754 | A1 | 3/2010 | Ishigaya et al. | |
| 2010/0092220 | A1 | 4/2010 | Hasegawa et al. | |
| 2010/0092221 | A1 | 4/2010 | Shinshi et al. | |
| 2010/0310266 | A1* | 12/2010 | Nakayama et al. | 399/67 |
| 2011/0064437 | A1 | 3/2011 | Yamashina et al. | |
| 2011/0091226 | A1 | 4/2011 | Ishigaya et al. | |
| 2011/0182634 | A1 | 7/2011 | Ishigaya et al. | |
| 2011/0217057 | A1 | 9/2011 | Yoshinaga et al. | |
| 2011/0274473 | A1 | 11/2011 | Shinshi et al. | |

OTHER PUBLICATIONS

U.S. Appl. No. 13/109,346, filed May 17, 2011, Yasunori Ishigaya, et al.

U.S. Appl. No. 13/252,543, filed Oct. 4, 2011, Yasunori Ishigaya, et al.

U.S. Appl. No. 13/272,629, filed Oct. 13, 2011, Takumi Waida, et al.

* cited by examiner

FIXING DEVICE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2010-275010, filed on Dec. 9, 2010, in the Japanese Patent Office, the entire disclosure of which is hereby incorporated by reference herein.

FIELD OF THE INVENTION

Exemplary aspects of the present invention relate to a fixing device and an image forming apparatus, and more particularly, to a fixing device for fixing a toner image on a recording medium, and an image forming apparatus including the fixing device.

BACKGROUND OF THE INVENTION

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to render the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may employ a fixing belt, formed into a loop, to apply heat to the recording medium bearing the toner image, and a pressing roller, disposed opposite the fixing belt, to apply pressure to the recording medium. A stationary, nip formation pad disposed inside the loop formed by the fixing belt is pressed against the pressing roller disposed outside the loop formed by the fixing belt via the fixing belt to form a fixing nip between the fixing belt and the pressing roller through which the recording medium bearing the toner image passes. As the fixing belt and the pressing roller rotate and convey the recording medium through the fixing nip, they apply heat and pressure to the recording medium to fix the toner image on the recording medium.

As a mechanism that heats the fixing belt, the fixing device may include an exciting coil disposed opposite the fixing belt, which generates a magnetic flux toward the fixing belt, thus heating a heat generation layer of the fixing belt by electromagnetic induction.

For example, Japanese publication No. P2009-282413A proposes a configuration in which a temperature-sensitive magnetic member, which generates heat by a magnetic flux generated by the exciting coil, separably contacts the inner circumferential surface of the fixing belt. Before the fixing belt is heated to a desired fixing temperature, the temperature-sensitive magnetic member is isolated from the fixing belt; therefore it does not draw heat from the fixing belt, shortening a warm-up time of the fixing belt. Conversely, after the fixing belt has been heated to the desired fixing temperature, the temperature-sensitive magnetic member contacts the fixing belt to conduct heat thereto supplementarily, thus maintaining the fixing temperature of the fixing belt.

However, such configuration has a drawback in that, even when the temperature-sensitive magnetic member is isolated from the fixing belt during warm-up, it is still heated by the magnetic flux generated by the exciting coil. That is, the magnetic flux is not concentrated solely on the fixing belt, thereby degrading heating efficiency for heating the fixing belt.

As another example, Japanese patent No. P3,527,442 proposes a configuration in which a conductive member is rotatably disposed inside a heating roller in such a manner that it is moved between the two positions: a first position where it is disposed opposite an exciting coil disposed outside the heating roller, and a second position where it is not disposed opposite the exciting coil. With this configuration, before the heating roller is heated to a desired fixing temperature, the conductive member is at the second position where it is not disposed opposite the exciting coil so that a magnetic flux generated by the exciting coil is concentrated solely on the heating roller, not reaching the conductive member. By contrast, after the heating roller has been heated to the desired fixing temperature, the conductive member is moved to the first position where it is disposed opposite the exciting coil.

However, such configuration also has a drawback in that the heating roller is constructed of a heat generation layer heated by the magnetic flux generated by the exciting coil and a temperature-sensitive magnetic layer, which prevents overheating of the heating roller, combined with the heat generation layer. Since the temperature-sensitive magnetic layer is combined with the heat generation layer, it draws heat from the heat generation layer, lengthening a warm-up time of the heating roller.

SUMMARY OF THE INVENTION

This specification describes below an improved fixing device. In one exemplary embodiment of the present invention, the fixing device includes a fixing rotary body, a pressing rotary body, a heat generator, a first exciting coil, a second exciting coil, an alternating electric current power supply, and a switch circuit. The fixing rotary body rotates in a predetermined direction of rotation and includes a first heat generation layer. The pressing rotary body is disposed parallel to and pressed against the fixing rotary body to form a fixing nip therebetween through which a recording medium bearing a toner image is conveyed. The heat generator including a second heat generation layer heats the fixing rotary body to a predetermined target temperature and separably contacts the fixing rotary body. The first exciting coil, which generates a magnetic flux, is disposed opposite the heat generator via the fixing rotary body in a first region. The second exciting coil, which generates a magnetic flux, is disposed opposite the heat generator via the fixing rotary body in a second region sandwiching the first region in the direction of rotation of the fixing rotary body. The alternating electric current power supply is connectable to the first exciting coil and the second exciting coil. The switch circuit is connected to the first exciting coil, the second exciting coil, and the alternating electric current power supply to selectively connect the alternating electric current power supply to the first exciting coil and the second exciting coil. When the switch circuit connects the alternating electric current power supply to both the first exciting coil and the second exciting coil, the first exciting coil and the second exciting coil together generate a first magnetic flux having a first density that reaches only the first heat generation layer of the fixing rotary body. When the switch circuit connects the alternating electric current power supply to the first exciting coil only, the first exciting coil generates a second magnetic flux having a second density greater than the first density that reaches both the first heat generation layer of the fixing rotary body and the second heat generation layer of the heat generator.

This specification further describes below an improved fixing device. In one exemplary embodiment of the present invention, the fixing device includes a fixing rotary body, a pressing rotary body, a first exciting coil, a second exciting coil, an alternating electric current power supply, and a switch circuit. The fixing rotary body rotates in a predetermined direction of rotation and includes a first heat generation layer. The pressing rotary body is disposed parallel to and pressed against the fixing rotary body to form a fixing nip therebetween through which a recording medium bearing a toner image is conveyed. The pressing rotary body includes a second heat generation layer to heat the fixing rotary body to a predetermined target temperature. The first exciting coil, which generates a magnetic flux, is disposed opposite the pressing rotary body via the fixing rotary body in a first region. The second exciting coil, which generates a magnetic flux, is disposed opposite the pressing rotary body via the fixing rotary body in a second region sandwiching the first region in the direction of rotation of the fixing rotary body. The alternating electric current power supply is connectable to the first exciting coil and the second exciting coil. The switch circuit is connected to the first exciting coil, the second exciting coil, and the alternating electric current power supply to selectively connect the alternating electric current power supply to the first exciting coil and the second exciting coil. When the switch circuit connects the alternating electric current power supply to both the first exciting coil and the second exciting coil, the first exciting coil and the second exciting coil together generate a first magnetic flux having a first density that reaches only the first heat generation layer of the fixing rotary body. When the switch circuit connects the alternating electric current power supply to the first exciting coil only, the first exciting coil generates a second magnetic flux having a second density greater than the first density that reaches both the first heat generation layer of the fixing rotary body and the second heat generation layer of the pressing rotary body.

This specification further describes an improved image forming apparatus. In one exemplary embodiment, the image forming apparatus includes the fixing device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
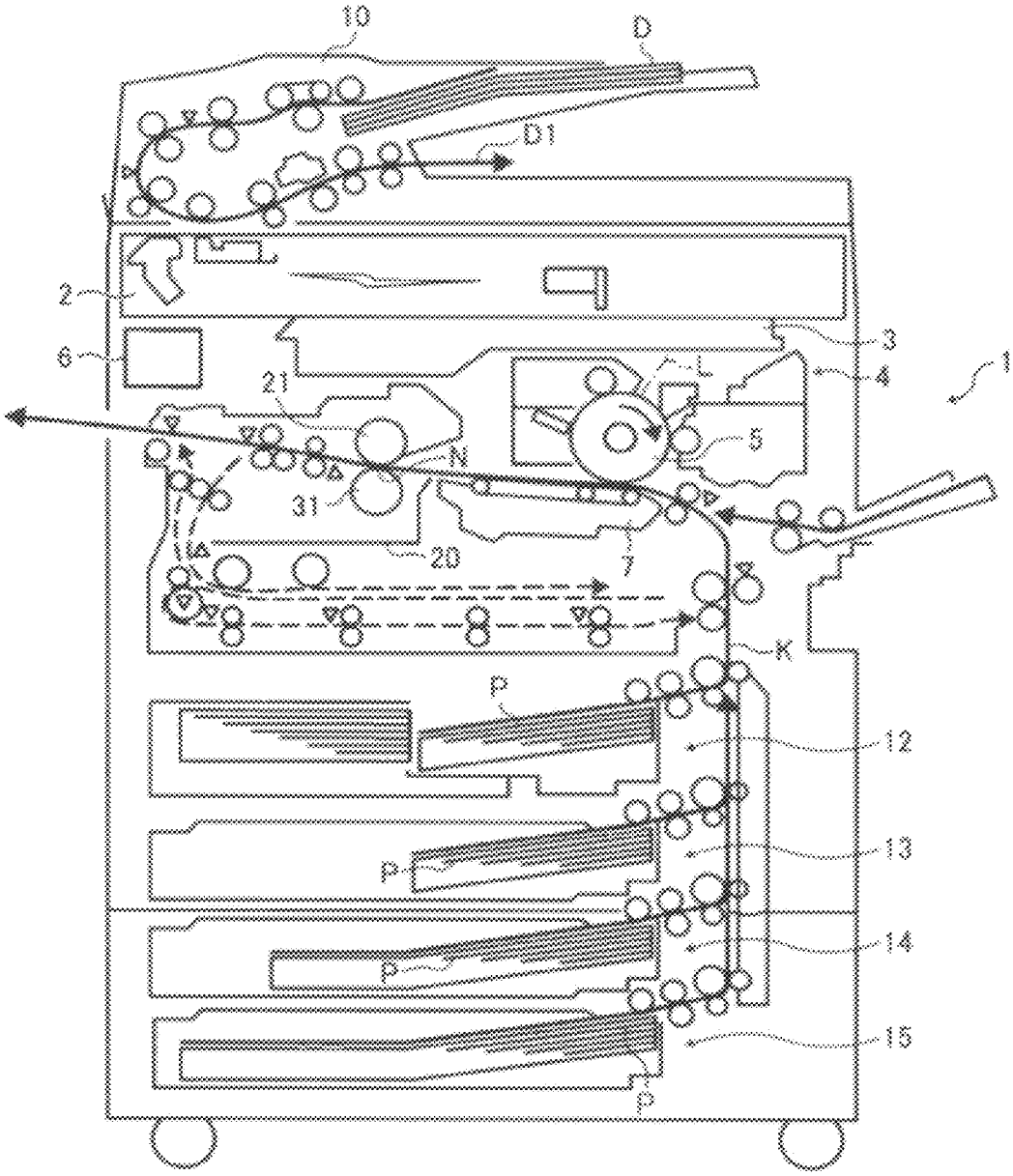
FIG. 1 is a schematic sectional view of an image forming apparatus according to a first exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present invention is explained.

Referring to FIGS. 1 to 7B, the following describes a first illustrative embodiment of the present invention.

Referring to FIG. 1, a description is now given of the structure of the image forming apparatus 1.

FIG. 1 is a schematic sectional view of the image forming apparatus 1. As illustrated in FIG. 1, the image forming apparatus 1 may be a copier, a facsimile machine, a printer, a multifunction printer having at least one of copying, printing, scanning, plotter, and facsimile functions, or the like. According to this exemplary embodiment of the present invention, the image forming apparatus 1 is a copier for forming a toner image on a recording medium.

As illustrated in FIG. 1, the image forming apparatus 1 includes an auto document feeder 10, disposed atop the image forming apparatus 1, which feeds an original document D bearing an original image placed thereon to an original document reader 2 disposed below the auto document feeder 10. The original document reader 2 optically reads the original image on the original document D to generate image data and sends it to an exposure device 3 disposed below the original document reader 2. The exposure device 3 emits light L onto a photoconductive drum 5 of an image forming device 4 disposed below the exposure device 3 according to the image data sent from the original document reader 2 to form an electrostatic latent image on the photoconductive drum 5. Thereafter, the image forming device 4 renders the electrostatic latent image formed on the photoconductive drum 5 visible as a toner image with developer (e.g., toner).

Below the image forming device 4 is a transfer device 7 that transfers the toner image formed on the photoconductive drum 5 onto a recording medium P sent from one of paper trays 12, 13, 14, and 15, each of which loads a plurality of recording media P (e.g., transfer sheets), disposed in a lower portion of the image forming apparatus 1 below the transfer device 7. The recording medium P bearing the transferred toner image is sent to a fixing device 20 disposed downstream from the transfer device 7 in a conveyance direction of the recording medium P, where a fixing belt 21 and a pressing roller 31 disposed opposite each other apply heat and pressure to the recording medium P, thus fixing the toner image on the recording medium P.

Referring to FIG. 1, a description is now given of the operation of the image forming apparatus 1 having the above-described structure.

An original document D bearing an original image, placed on an original document tray of the auto document feeder 10 by a user, is conveyed by a plurality of conveyance rollers of the auto document feeder 10 in a direction D1 above the original document reader 2. As the original document D passes over an exposure glass of the original document reader 2, the original document reader 2 optically reads the original image on the original document D to generate image data.

The image data are converted into an electric signal and then sent to the exposure device 3. The exposure device 3, serving as a writer, emits light L (e.g., a laser beam) onto the photoconductive drum 5 of the image forming device 4 according to the electric signal, thus writing an electrostatic latent image on the photoconductive drum 5.

The image forming device 4 performs a plurality of image forming processes as the photoconductive drum 5 rotates clockwise in FIG. 1: a charging process, an exposure process, and a development process. In the charging process, a charger of the image forming device 4 charges an outer circumferential surface of the photoconductive drum 5, accordingly the exposure device 3 emits light L onto the charged outer circumferential surface of the photoconductive drum 5 to form an electrostatic latent image thereon as described above in the exposure process. Thereafter, in the development process, a development device of the image forming device 4 develops the electrostatic latent image formed on the photoconductive drum 5 into a toner image with toner.

On the other hand, a recording medium P is sent to a transfer nip formed between the photoconductive drum 5 and the transfer device 7 from one of the plurality of paper trays 12 to 15, which is selected manually by the user using a control panel disposed atop the image forming apparatus 1 or automatically by an electric signal of a print job sent from a client computer. If the paper tray 12 is selected, for example, an uppermost recording medium P of a plurality of recording media P loaded in the paper tray 12 is conveyed to a registration roller pair disposed in a conveyance path K extending from each of the paper trays 12 to 15 to the transfer device 7.

When the uppermost recording medium P reaches the registration roller pair, it is stopped by the registration roller pair temporarily and then conveyed to the transfer nip formed between the photoconductive drum 5 and the transfer device 7 at a time when the toner image formed on the photoconductive drum 5 is transferred onto the uppermost recording medium P by the transfer device 7.

After the transfer of the toner image onto the recording medium P, the recording medium P bearing the toner image is sent to the fixing device 20 through a conveyance path extending from the transfer device 7 to the fixing device 20. As the recording medium P passes through a fixing nip N formed between the fixing belt 21 and the pressing roller 31 of the fixing device 20, it receives heat from the fixing belt 21 and pressure from the fixing belt 21 and the pressing roller 31, which fix the toner image on the recording medium P. Thereafter, the recording medium P bearing the fixed toner image is discharged from the fixing nip N to an outside of the image forming apparatus 1, thus completing a series of image forming processes.

Referring to FIGS. 2, 3A, 3B, 4A, and 4B, the following describes the structure and operation of the fixing device 20 installed in the image forming apparatus 1 described above.

Figure 2:
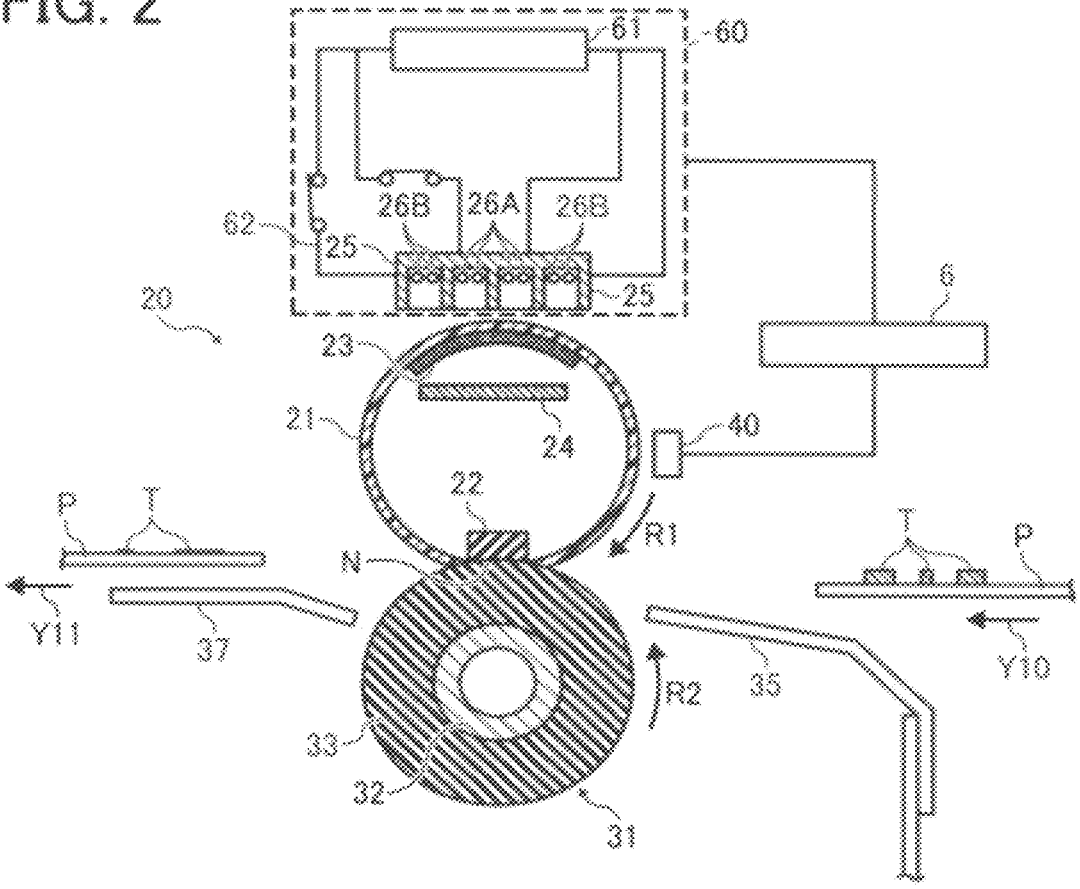
FIG. 2 is a vertical sectional view of a fixing device installed in the image forming apparatus shown in FIG. 1.
Figure 3A:
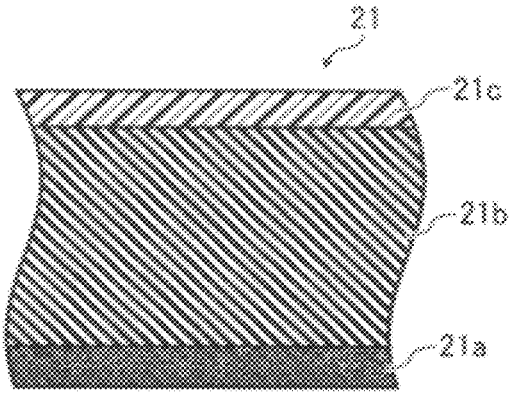
FIG. 3A is a partial vertical sectional view of a fixing belt installed in the fixing device shown in FIG. 2.
Figure 3B:
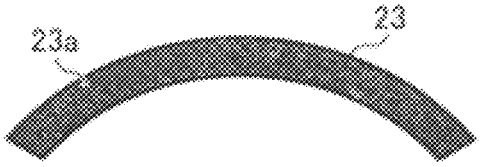
FIG. 3B is a vertical sectional view of a heat generator installed in the fixing device shown in FIG. 2.
Figure 4A:
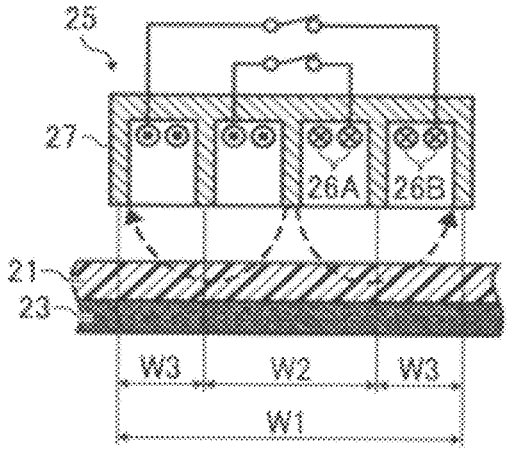
FIG. 4A is a partially enlarged vertical sectional view of the fixing belt shown in FIG. 3A, the heat generator shown in FIG. 3B, and an exciting coil unit installed in the fixing device shown in FIG. 2 in a first heating state.
Figure 4B:
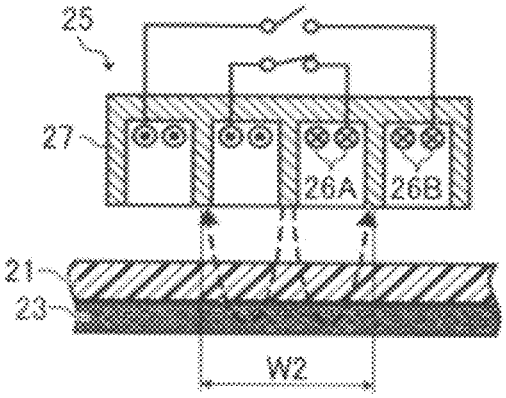
FIG. 4B is a partially enlarged vertical sectional view of the fixing belt shown in FIG. 3A, the heat generator shown in FIG. 3B, and an exciting coil unit installed in the fixing device shown in FIG. 2 in a second heating state.

FIG. 2 is a vertical sectional view of the fixing device 20. FIG. 3A is a partial vertical sectional view of the fixing belt 21 of the fixing device 20. FIG. 3B is a vertical sectional view of a heat generator 23 of the fixing device 20. FIG. 4A is a partially enlarged vertical sectional view of the fixing belt 21, the heat generator 23, and an exciting coil unit 25 of the fixing device 20. FIG. 4B is a partially enlarged vertical sectional view of the fixing belt 21, the heat generator 23, and the exciting coil unit 25.

As illustrated in FIG. 2, the fixing device 20 includes the fixing belt 21 formed into a loop; a nip formation pad 22, the heat generator 23, and a shield 24, which are disposed inside the loop formed by the fixing belt 21; and an exciting circuit 60, the pressing roller 31, a temperature sensor 40, and guides 35 and 37, which are disposed outside the loop formed by the fixing belt 21.

The fixing belt 21 is a flexible, thin endless belt serving as a fixing rotary body that rotates or moves clockwise in FIG. 2 in a rotation direction R1. As illustrated in FIG. 3A, the fixing belt 21, having a thickness not greater than about 1 mm, is constructed of multiple layers: a first heat generation layer 21*a* as a base layer; an elastic layer 21*b* disposed on the first heat generation layer 21*a*; and a release layer 21*c* disposed on the elastic layer 21*b*.

For example, the first heat generation layer 21*a* constitutes an inner circumferential surface of the fixing belt 21, that is, a contact face sliding over the nip formation pad 22 and the heat generator 23 disposed inside the loop formed by the fixing belt 21. The first heat generation layer 21*a*, made of a conductive material having a relatively low heat capacity, has a thickness in a range of from about several microns to about several hundred microns, preferably in a range of from about ten microns to about several tens of microns, thus serving as a heat generation layer heated by the exciting coil unit 25 by electromagnetic induction.

The elastic layer 21*b*, made of a rubber material such as silicone rubber, silicone rubber foam, and/or fluorocarbon rubber, has a thickness in a range of from about 100 μm to about 300 μm. The elastic layer 21*b* eliminates or reduces slight surface asperities of the fixing belt 21 at the fixing nip N formed between the fixing belt 21 and the pressing roller 31. Accordingly, heat is uniformly conducted from the fixing belt 21 to a toner image T on a recording medium P passing through the fixing nip N, minimizing formation of a rough image such as an orange peel image. According to the first illustrative embodiment, silicone rubber with a thickness of about 200 μm is used as the elastic layer 21*b*.

The release layer 21*c*, having a thickness in a range of from about 10 μm to about 50 μm, is made of tetrafluoroethylene-perfluoroalkylvinylether copolymer (PFA), polytetrafluoroethylene (PTFE), polyimide, polyetherimide, and/or polyether sulfide (PES). The release layer 21*c* releases or separates the toner image T from the fixing belt 21.

Inside the loop formed by the fixing belt 21 are fixedly disposed the nip formation pad 22, the heat generator 23, and the shield 24. Outside the loop formed by the fixing belt 21 is the exciting coil unit 25 serving as an induction heater disposed opposite the fixing belt 21 with a predetermined gap between the exciting coil unit 25 and a part of an outer circumferential surface of the fixing belt 21. The inner circumferential surface of the fixing belt 21 is applied with a lubricant that reduces friction between an outer circumferential surface of the nip formation pad 22 and the heat generator 23 and the inner circumferential surface of the fixing belt 21 sliding over the nip formation pad 22 and the heat generator 23.

The nip formation pad 22 contacting the inner circumferential surface of the fixing belt 21 is a stationary member fixedly disposed inside the loop formed by the fixing belt 21; thus, the rotating fixing belt 21 slides over the stationary, nip formation pad 22. Further, the nip formation pad 22 presses against the pressing roller 31 via the fixing belt 21 to form the fixing nip N between the fixing belt 21 and the pressing roller 31 through which the recording medium P bearing the toner image T passes. Lateral ends of the nip formation pad 22 in a longitudinal direction thereof parallel to an axial direction of the fixing belt 21 are mounted on and supported by side plates of the fixing device 20, respectively. The nip formation pad 22 is made of a rigid material that prevents substantial bending of the nip formation pad 22 by pressure applied from the pressing roller 31.

The nip formation pad 22 constitutes an opposed face (e.g., a contact face that contacts the inner circumferential surface of the fixing belt 21 sliding over the nip formation pad 22) facing the pressing roller 31 and having a concave shape corresponding to the curvature of the pressing roller 31. The recording medium P moves along the concave, opposed face of the nip formation pad 22 corresponding to the curvature of the pressing roller 31 and is discharged from the fixing nip N in a direction Y11. Thus, the concave shape of the nip formation pad 22 prevents the recording medium P bearing the fixed toner image T from adhering to the fixing belt 21, thereby facilitating separation of the recording medium P from the fixing belt 21.

As described above, according to the first illustrative embodiment, the nip formation pad 22 has a concave shape to form the concave fixing nip N. Alternatively, however, the nip formation pad 22 may have a flat, planar shape to form a planar fixing nip N. Specifically, the opposed face of the nip formation pad 22 disposed opposite the pressing roller 31 may have a flat, planar shape. Accordingly, the planar fixing nip N formed by the planar opposed face of the nip formation pad 22 is substantially parallel to an imaged side of the recording medium P. Consequently, the fixing belt 21 pressed by the planar opposed face of the nip formation pad 22 is precisely adhered to the recording medium P to improve fixing performance. Further, the increased curvature of the fixing belt 21 at an exit of the fixing nip N facilitates separation of the recording medium P discharged from the fixing nip N from the fixing belt 21.

As illustrated in FIG. 2, the heat generator 23, contacting the inner circumferential surface of the fixing belt 21, is disposed opposite the exciting coil unit 25 via the fixing belt 21. Lateral ends of the heat generator 23 in a longitudinal direction thereof parallel to the axial direction of the fixing belt 21 are mounted on and supported by the side plates of the fixing device 20, respectively.

As illustrated in FIG. 3B, the heat generator 23 is constructed of a single layer, a second heat generation layer 23*a* made of a conductive material. The second heat generation layer 23*a* is heated by the exciting coil unit 25 (depicted in FIG. 2) serving as an induction heater that heats the second heat generation layer 23*a* by electromagnetic induction. Specifically, the exciting coil unit 25 generates an alternating magnetic field that heats the second heat generation layer 23*a* of the heat generator 23 by electromagnetic induction, which in turn heats the fixing belt 21. In other words, the exciting coil unit 25 heats the heat generator 23 directly by electromagnetic induction and at the same time heats the fixing belt 21 indirectly via the heat generator 23.

As described above, since the fixing belt 21 has the first heat generation layer 21*a*, the alternating magnetic field generated by the exciting coil unit 25 also heats the first heat generation layer 21*a* by electromagnetic induction. In other words, the fixing belt 21 is heated by the exciting coil unit 25 directly by electromagnetic induction and at the same time is heated by the heat generator 23, which is heated by the exciting coil unit 25 by electromagnetic induction, indirectly, resulting in improved heating efficiency for heating the fixing belt 21. Thus, heat is conducted from the outer circumferential surface of the fixing belt 21 to the toner image T on the recording medium P passing through the fixing nip N formed between the fixing belt 21 and the pressing roller 31.

The temperature sensor 40 (e.g., a thermistor or a thermopile), disposed opposite the outer circumferential surface of the fixing belt 21, serves as a temperature detector that detects a temperature of the outer circumferential surface of the fixing belt 21. Based on the temperature detected by the temperature sensor 40, a controller 6, that is, a central processing unit (CPU) provided with a random-access memory (RAM) and a read-only memory (ROM), for example, controls output of the exciting coil unit 25, thus adjusting the temperature of the fixing belt 21 to a desired fixing temperature.

As illustrated in FIGS. 4A and 4B, the exciting coil unit 25 includes two exciting coils, that is, a first exciting coil 26A and a second exciting coil 26B, and an exciting coil core 27. Each of the first exciting coil 26A and the second exciting coil 26B, extending in a longitudinal direction of the exciting coil unit 25 parallel to the axial direction of the fixing belt 21, is constructed of litz wire made of bundled thin wires wound around the exciting coil core 27 that covers a part of the outer circumferential surface of the fixing belt 21. As an alternating electric current power supply 61 depicted in FIG. 2 supplies an alternating electric current to the first exciting coil 26A and/or the second exciting coil 26B, the exciting coil unit 25 generates a magnetic flux toward the first heat generation layer 21*a* depicted in FIG. 3A of the fixing belt 21 and/or the second heat generation layer 23*a* depicted in FIG. 3B of the heat generator 23. The exciting coil core 27, made of ferromagnet (e.g., ferrite) having a relative permeability of about 2,500, generates a magnetic flux toward the first heat generation layer 21*a* of the fixing belt 21 and the second heat generation layer 23*a* of the heat generator 23 efficiently.

As shown in FIG. 4B, the first exciting coil 26A is disposed opposite the outer circumferential surface of the fixing belt 21 in a region W2 thereof in the rotation direction R1 of the fixing belt 21. By contrast, as shown in FIG. 4A, the second exciting coil 26B is disposed opposite the outer circumferential surface of the fixing belt 21 in regions W3 thereof sandwiching the region W2 in the rotation direction R1 of the fixing belt 21. By changing the number of exciting coils connected to the alternating electric current power supply 61, that is, the first exciting coil 26A only as shown in FIG. 4B or both the first exciting coil 26A and the second exciting coil 26B as shown in FIG. 4A, the density of a magnetic flux passing through the first heat generation layer 21*a* of the fixing belt 21 is changeable, a description of which is deferred.

As illustrated in FIG. 2, the shield 24, disposed opposite the exciting coil unit 25 via the heat generator 23 and the fixing belt 21, is a plate made of a non-magnetic metal material such as aluminum and/or copper which shields the magnetic flux generated by the exciting coil unit 25. Thus, even when the magnetic flux generated by the exciting coil unit 25 penetrates the fixing belt 21 and the heat generator 23, the shield 24 generates an eddy current that offsets the penetrating magnetic flux, reducing leakage of the magnetic flux from the fixing belt 21 and the heat generator 23 for improved heating efficiency for heating the fixing belt 21.

As illustrated in FIG. 2, the pressing roller 31 serves as a pressing rotary body that presses against the outer circumferential surface of the fixing belt 21 at the fixing nip N. The pressing roller 31 is constructed of a hollow metal core 32 and an elastic layer 33 disposed on the metal core 32. The elastic layer 33, having a thickness of about 3 mm, is made of silicone rubber foam, silicone rubber, and/or fluorocarbon rubber. Optionally, a thin surface release layer made of PFA and/or PTFE may be disposed on the elastic layer 33. The pressing roller 31 is pressed against the nip formation pad 22 via the fixing belt 21 to form the desired fixing nip N between the pressing roller 31 and the fixing belt 21.

On the pressing roller 31 is mounted a gear engaging a driving gear of a driving mechanism that drives and rotates the pressing roller 31 counterclockwise in FIG. 2 in a rotation direction R2 counter to the rotation direction R1 of the fixing belt 21. Lateral ends of the pressing roller 31 in a longitudinal direction, that is, an axial direction thereof, are rotatably supported by the side plates of the fixing device 20 via bearings, respectively. Optionally, a heat source, such as a halogen heater, may be disposed inside the pressing roller 31.

With the elastic layer 33 of the pressing roller 31 made of a sponge material such as silicone rubber foam, the pressing roller 31 applies decreased pressure to the nip formation pad 22 via the fixing belt 21 at the fixing nip N to decrease bending of the nip formation pad 22. Further, the pressing roller 31 provides increased heat insulation that minimizes heat conduction thereto from the fixing belt 21, improving heating efficiency of the fixing belt 21.

As a mechanism to convey the recording medium P bearing the toner image T to and from the fixing nip N formed between the fixing belt 21 and the pressing roller 31, the fixing device 20 includes two guide plates, the guide 35 disposed at an entry to the fixing nip N and the guide 37 disposed at an exit of the fixing nip N. The guide 35 is directed to the entry to the fixing nip N to guide the recording medium P conveyed in a direction Y10 from the transfer device 7 depicted in FIG. 1 to the fixing nip N. The guide 37 is directed to a conveyance path downstream from the fixing device 20 in the conveyance direction of the recording medium P to guide the recording medium P discharged from the fixing nip N in the direction Y11 to the conveyance path. Both the guides 35 and 37 are mounted on a frame (e.g., a body) of the fixing device 20.

Referring to FIGS. 1 and 2, the following describes the operation of the fixing device 20 having the above-described structure.

When the image forming apparatus 1 is powered on, a high-frequency power supply, that is, the alternating electric current power supply 61, supplies an alternating electric current to the first exciting coil 26A and the second exciting coil 26B of the exciting coil unit 25, and at the same time the pressing roller 31 starts rotating in the rotation direction R2. Accordingly, the fixing belt 21 rotates in accordance with rotation of the pressing roller 31 in the rotation direction R1 counter to the rotation direction R2 of the pressing roller 31 due to friction therebetween at the fixing nip N.

Thereafter, at the transfer nip formed between the photoconductive drum 5 and the transfer device 7, the toner image T formed on the photoconductive drum 5 as described above is transferred onto a recording medium P sent from one of the paper trays 12 to 15. Being guided by the guide 35, the recording medium P bearing the toner image T is conveyed from the transfer nip in the direction Y10 toward the fixing nip N, entering the fixing nip N formed between the fixing belt 21 and the pressing roller 31 pressed against each other.

As the recording medium P bearing the toner image T passes through the fixing nip N, it receives heat from the fixing belt 21 and pressure from the fixing belt 21, the nip formation pad 22, and the pressing roller 31 that form the fixing nip N. Thus, the toner image T is fixed on the recording medium P by the heat and the pressure applied at the fixing nip N. Thereafter, the recording medium P bearing the fixed toner image T is discharged from the fixing nip N and conveyed in the direction Y11 as guided by the guide 37.

Referring to FIGS. 2, 3A, 3B, 4A, and 4B, the following describes the configuration of the fixing device 20 according to the first illustrative embodiment of the present invention.

The fixing device 20 according to the first illustrative embodiment has a configuration that changes the density of a magnetic flux applied from the exciting coil unit 25 to the first heat generation layer 21*a* of the fixing belt 21. For example, as shown in FIGS. 2, 4A, and 4B, the exciting coil unit 25 includes the two exciting coils, that is, the first exciting coil 26A and the second exciting coil 26B disposed opposite the outer circumferential surface of the fixing belt 21 in different widths, respectively, in the rotation direction R1 of the fixing belt 21. Specifically, as shown in FIG. 4B, the first exciting coil 26A disposed at a center of the exciting coil unit 25 in the rotation direction R1 of the fixing belt 21 is disposed opposite the outer circumferential surface of the fixing belt 21 in the region W2 thereof. By contrast, as shown in FIG. 4A, the second exciting coil 26B disposed at lateral ends of the exciting coil unit 25 in the rotation direction R1 of the fixing belt 21 is disposed opposite the outer circumferential surface of the fixing belt 21 in the regions W3 thereof sandwiching the region W2.

The first exciting coil 26A and the second exciting coil 26B are connected to a switch circuit 62 that connects the first exciting coil 26A and the second exciting coil 26B to the alternating electric current power supply 61 independently.

With this configuration of the first exciting coil 26A and the second exciting coil 26B, the exciting circuit 60 changes the density of a magnetic flux applied from the exciting coil unit 25 to the first heat generation layer 21*a* of the fixing belt 21, thus switching between a first heating state shown in FIG. 4A in which the exciting coil unit 25 heats only the first heat generation layer 21*a* of the fixing belt 21 by electromagnetic induction to heat the fixing belt 21 and a second heating state shown in FIG. 4B in which the exciting coil unit 25 heats both the first heat generation layer 21*a* of the fixing belt 21 and the second heat generation layer 23*a* of the heat generator 23 by electromagnetic induction to heat the fixing belt 21 directly and at the same time heat the fixing belt 21 indirectly via the heat generator 23. Specifically, the switch circuit 62 installed in the exciting circuit 60 changes the number of exciting coils connected to the alternating electric current power supply 61, that is, only the first exciting coil 26A or both the first exciting coil 26A and the second exciting coil 26B, thus changing the density of a magnetic flux applied from the exciting coil unit 25 to the first heat generation layer 21*a* of the fixing belt 21 to switch between the first heating state and the second heating state.

For example, as shown in FIG. 4A, when the first exciting coil 26A and the second exciting coil 26B are connected to the alternating electric current power supply 61, the first exciting coil 26A and the second exciting coil 26B apply a magnetic flux to the fixing belt 21 throughout a region W1, that is, a combination of the region W2 and the regions W3, thus decreasing the density of the magnetic flux applied from the exciting coil unit 25 to the first heat generation layer 21*a* of the fixing belt 21. Accordingly, the magnetic flux generated by the exciting coil unit 25, which is indicated by the broken line, reaches the first heat generation layer 21*a* of the fixing belt 21 only and does not reach the second heat generation layer 23*a* of the heat generator 23. Consequently, the exciting coil unit 25 heats only the first heat generation layer 21*a* of the fixing belt 21 by electromagnetic induction in the first heating state. Since the magnetic flux generated by the exciting coil unit 25 is concentrated on the first heat generation layer 21*a* only, the first heat generation layer 21*a* is heated quickly. It is to be noted that, although heat is conducted from the fixing belt 21 to the heat generator 23 in the first heating state, the heat generator 23 contacts a part of the inner circumferential surface of the fixing belt 21 in a circumferential direction of the fixing belt 21 at a limited area with a relatively small heat capacity, minimizing reduction of heating efficiency of the fixing belt 21.

By contrast, as shown in FIG. 4B, when only the first exciting coil 26A is connected to the alternating electric current power supply 61 and the second exciting coil 26B is disconnected, only the first exciting coil 26A applies a magnetic flux to the fixing belt 21 in the region W2 thereof, that is smaller than the region W1, thus increasing the density of the magnetic flux applied from the exciting coil unit 25 to the first heat generation layer 21*a* of the fixing belt 21. Accordingly, the magnetic flux generated by the exciting coil unit 25, which is indicated by the broken line, penetrates the first heat generation layer 21*a* of the fixing belt 21 and reaches the second heat generation layer 23*a* of the heat generator 23. Thus, the exciting coil unit 25 heats the second heat generation layer 23*a* of the heat generator 23 as well as the first heat generation layer 21*a* of the fixing belt 21 by electromagnetic induction in the second heating state. Since the magnetic flux generated by the exciting coil unit 25 is diffused to the second heat generation layer 23*a* of the heat generator 23 also, the heat generator 23 heats the fixing belt 21 supplementarily to maintain the desired fixing temperature of the fixing belt 21.

In both the first heating state and the second heating state, the exciting coil unit 25 generates the same magnetic field. However, the density of the magnetic flux applied to the first heat generation layer 21*a* of the fixing belt 21 in the second heating state is higher than that in the first heating state by about an amount obtained by dividing the region W1 by the region W2. In other words, the density of the magnetic flux applied from the exciting coil unit 25 to the first heat generation layer 21*a* of the fixing belt 21 is inversely proportional to the size of the region in which the exciting coils supplied with an electric current from the alternating electric current power supply 61 are disposed opposite the fixing belt 21.

As described above, the magnetic flux generated by the exciting coil unit 25 is applied to a region, that is, a skin depth, of the first heat generation layer 21*a* of the fixing belt 21 that varies depending on the density of the magnetic flux applied to the first heat generation layer 21*a*. This is because the skin depth is proportional to the specific resistance of the first heat generation layer 21*a* and inversely proportional to the magnetic permeability of the first heat generation layer 21*a* and the frequency of the alternating electric current that excites the first heat generation layer 21*a*. Since the density of the magnetic flux applied to the first heat generation layer 21*a* of the fixing belt 21 is inversely proportional to the frequency of the alternating electric current, the skin depth is proportional to the density of the magnetic flux applied to the first heat generation layer 21*a* of the fixing belt 21.

With the configuration described above for switching between the first heating state and the second heating state according to the condition of the fixing device 20 described below, the fixing belt 21 is heated in the appropriate heating state selected according to the temperature of the fixing belt 21, improving heating efficiency for heating the fixing belt 21 by electromagnetic induction and shortening the time required to heat the fixing belt 21 to the desired fixing temperature.

For example, according to the first illustrative embodiment, the controller 6 depicted in FIG. 2 controls switching of the exciting coil connected to the alternating electric current power supply 61 between the first exciting coil 26A and the second exciting coil 26B, that is, the second exciting coil 26B is connected or disconnected to the alternating electric current power supply 61, so that the fixing device 20 is in the first heating state when the fixing device 20 or the image forming apparatus 1 depicted in FIG. 1 is warmed up and in the second heating state when the plurality of recording media P bearing the toner image T is conveyed through the fixing nip N of the fixing device 20 continuously, that is, when the controller 6 depicted in FIG. 1 receives a print job of forming a toner image Ton the plurality of recording media P.

With such control, even when the fixing belt 21 is cool in the morning after the image forming apparatus 1 has been powered off for a long time, the fixing belt 21 is heated quickly in the first heating state. Conversely, as the plurality of recording media P is conveyed through the fixing nip N formed between the fixing belt 21 and the pressing roller 31 continuously, they draw heat from the fixing belt 21, decreasing the temperature of the fixing belt 21 gradually. To address this problem, the exciting coil unit 25 heats the fixing belt 21 in the second heating state to conduct heat generated by the heat generator 23 to the fixing belt 21, thus heating the fixing belt 21 supplementarily to offset the temperature decrease of the fixing belt 21 and minimizing formation of a faulty toner image due to the decreased temperature of the fixing belt 21 caused by the recording media P conveyed through the fixing nip N continuously.

According to the first illustrative embodiment, in the first heating state shown in FIG. 4A, the density of a magnetic flux applied from the exciting coil unit 25 to the first heat generation layer 21*a* of the fixing belt 21 is smaller than the saturation magnetic flux density of the first heat generation layer 21*a*. Conversely, in the second heating state shown in FIG. 4B, the density of a magnetic flux applied from the exciting coil unit 25 to the first heat generation layer 21*a* of the fixing belt 21 is greater than the saturation magnetic flux density of the first heat generation layer 21*a*.

Figure 5:
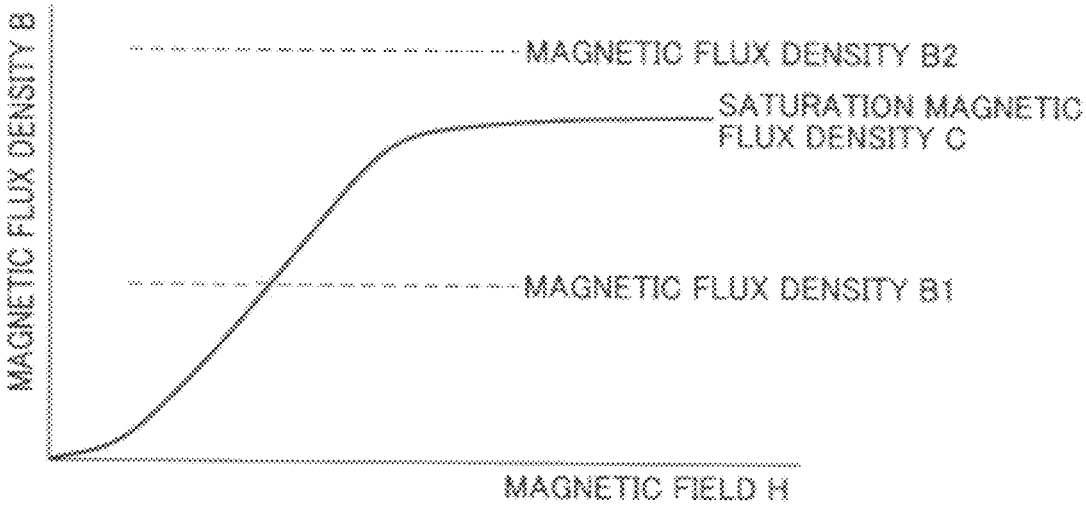
FIG. 5 is a graph illustrating a relation between a magnetic field generated in the fixing belt shown in FIG. 3A and the density of a magnetic flux generated by the exciting coil unit shown in FIG. 4A.

FIG. 5 is a graph showing a relation between a magnetic field H, that is, a coil magnetic field, generated in proximity to the first heat generation layer 21*a* and a magnetic flux density B, that is, the density of a magnetic flux applied to the first heat generation layer 21*a* of the fixing belt 21 with the first heat generation layer 21*a* made of a ferromagnetic material such as iron, nickel, cobalt, and/or an alloy of these.

As shown in FIG. 5, the greater the magnetic field H, the greater the magnetic flux density B of a magnetic flux applied to the first heat generation layer 21*a*. However, at a substantially great size of the magnetic field H, the magnetic flux density B is saturated at a saturation magnetic flux density C. When the controller 6 depicted in FIG. 2 controls the exciting coil unit 25 to generate a magnetic flux of a magnetic flux density B1 smaller than the saturation magnetic flux density C, the magnetic flux generated by the exciting coil unit 25 does reach the first heat generation layer 21*a* but does not penetrate it in the first heating state shown in FIG. 4A. By contrast, when the controller 6 controls the exciting coil unit 25 to generate a magnetic flux of a magnetic flux density B2 greater than the saturation magnetic flux density C, the magnetic flux generated by the exciting coil unit 25 penetrates the first heat generation layer 21*a* and reaches the second heat generation layer 23*a* of the heat generator 23 in the second heating state shown in FIG. 4B.

Referring to FIGS. 2, 3A, 4A, 4B, and 6, the following describes the material of the first heat generation layer 21*a* of the fixing belt 21.

The first heat generation layer 21*a* is made of a magnetic shunt metal material having ferromagnetism such as iron, nickel, cobalt, and/or an alloy of these, preferably a magnetic shunt metal material having property changing from ferromagnetism to paramagnetism such as iron, nickel, silicone, boron, niobium, copper, zirconium, cobalt, and/or an alloy of these.

With the first heat generation layer 21*a* made of the above-described material, when a Curie temperature of the first heat generation layer 21*a* is set to around a predetermined fixing temperature, the fixing belt 21 is not heated to above the fixing temperature. Accordingly, ripple in the temperature of the fixing belt 21 is decreased even when the plurality of recording media P is conveyed through the fixing nip N continuously, stabilizing fixing performance and gloss application to the fixed toner image T on the recording medium P.

Further, when a Curie temperature of the first heat generation layer 21*a* is set to not greater than an upper temperature limit of the fixing belt 21, non-conveyance regions NR on the fixing belt 21, provided at lateral ends thereof in the axial direction, through which small recording media P do not pass are not overheated to above the upper temperature limit of the fixing belt 21. Accordingly, even when small recording media P, which have a small width in the axial direction of the fixing belt 21 and therefore do not pass through the non-conveyance regions NR on the fixing belt 21, are conveyed through the fixing nip N continuously, the fixing belt 21 may not be overheated due to absence of the recording media P that draw heat from the non-conveyance regions NR on the fixing belt 21.

Figure 6:
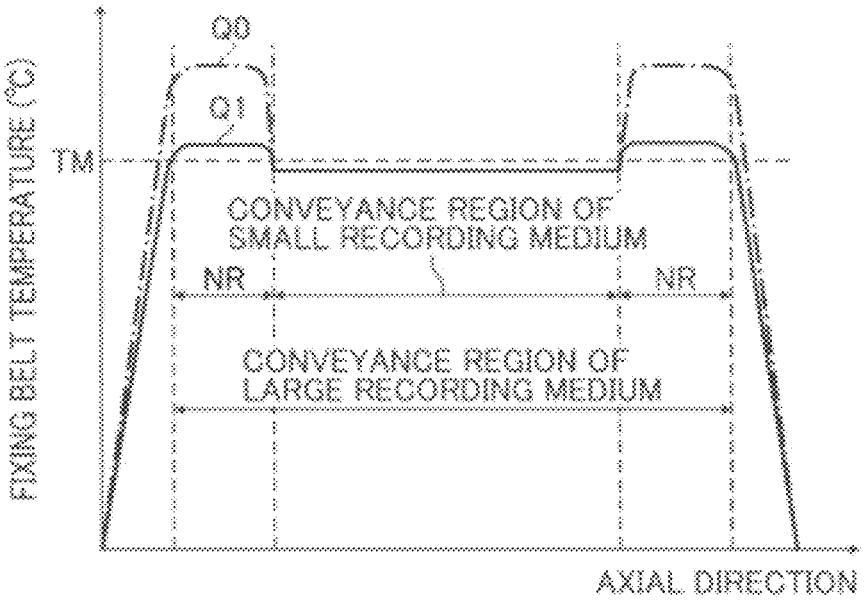
FIG. 6 is a graph illustrating a temperature distribution of the fixing belt shown in FIG. 3A in an axial direction thereof when small recording media are conveyed through a fixing nip of the fixing device shown in FIG. 2 continuously.

FIG. 6 is a graph illustrating a temperature distribution of the fixing belt 21 in the axial direction thereof when small recording media P are conveyed through the fixing nip N continuously. The graph shows the two lines: a line Q0, that is, the alternate-long-and-short-dashed line, indicating the temperature distribution of the fixing belt 21 with the first heat generation layer 21*a* made of general metal; and a line Q1, that is, the solid line, indicating the temperature distribution of the fixing belt 21 with the first heat generation layer 21*a* made of a magnetic shunt metal material. The line Q1 shows that, with the first heat generation layer 21*a* made of the magnetic shunt metal material, the temperature of the fixing belt 21 is suppressed to around a predetermined fixing temperature TM even in the non-conveyance regions NR thereon through which small recording media P do not pass.

Alternatively, the first heat generation layer 21*a* of the fixing belt 21 may be made of a non-magnetic metal material such as gold, silver, copper, aluminum, zinc, tin, lead, bismuth, beryllium, antimony, and/or an alloy of these.

With the first heat generation layer 21*a* made of the above-described alternative material, even when the distance between the exciting coil unit 25 and the fixing belt 21 disposed opposite each other changes, an amount of a magnetic flux generated by the exciting coil unit 25 and penetrating the fixing belt 21 does not change substantially, minimizing variation in heating of the fixing belt 21 in the axial direction thereof. Moreover, even when the fixing belt 21 is displaced or skewed in the axial direction thereof as it rotates in the rotation direction R1, it can be heated substantially uniformly in the axial direction thereof.

Preferably, the first heat generation layer 21*a* of the fixing belt 21 has a thickness smaller than a skin depth when an alternating electric current of a predetermined frequency is applied to the first exciting coil 26A and the second exciting coil 26B of the exciting coil unit 25. The "skin depth" defines a value obtained based on the specific resistance and the magnetic permeability of the first heat generation layer 21*a* and the frequency of the alternating electric current that excites the first heat generation layer 21*a*. According to the first illustrative embodiment, the frequency of the alternating electric current output from the alternating electric current power supply 61 is in a range of from about 20 kHz to about 100 kHz.

Thus, with the first heat generation layer 21*a* having the thickness smaller than the skin depth as described above according to the first illustrative embodiment, the magnetic flux generated by the exciting coil unit 25 precisely reaches the second heat generation layer 23*a* of the heat generator 23 in the second heating state shown in FIG. 4B.

Referring to FIGS. 2, 3B, 4A, and 4B, the following describes the material of the second heat generation layer 23*a* of the heat generator 23.

The second heat generation layer 23*a* is made of a magnetic shunt metal material having property changing from ferromagnetism to paramagnetism such as iron, nickel, silicone, boron, niobium, copper, zirconium, cobalt, and/or an alloy of these.

With the second heat generation layer 23*a* made of the above-described material, when a Curie temperature of the second heat generation layer 23*a* is set to a temperature higher than the predetermined fixing temperature and not higher than the upper temperature limit of the fixing belt 21, the fixing belt 21 is not overheated. When the temperature of the second heat generation layer 23*a* exceeds the Curie temperature, the magnetic flux generated by the exciting coil unit 25 penetrates the second heat generation layer 23*a* and reaches the shield 24 made of a non-magnetic material; the shield 24 generates an eddy current that offsets the penetrating magnetic flux.

Alternatively, the second heat generation layer 23*a* of the heat generator 23 may be made of a ferromagnetic metal material such as iron, nickel, and/or cobalt.

With the second heat generation layer 23*a* made of the above-described material, even in the second heating state shown in FIG. 4B, the magnetic flux generated by the exciting coil unit 25 does not penetrate the second heat generation layer 23*a* of the heat generator 23, thus improving heating efficiency for heating the heat generator 23 by electromagnetic induction even without the shield 24.

According to the first illustrative embodiment described above, the heat generator 23 is constructed of the single layer, that is, the second heat generation layer 23*a*. Alternatively, the heat generator 23 may be constructed of multiple layers: an inner surface layer serving as a heat generation layer, which generates heat by electromagnetic induction, equivalent to the second heat generation layer 23*a*; an intermediate layer made of a high-thermal conductive material such as aluminum, iron, and/or stainless steel; and an outer surface layer serving as another heat generation layer, which generates heat by electromagnetic induction, equivalent to the second heat generation layer 23*a*, for example.

Figure 7A:
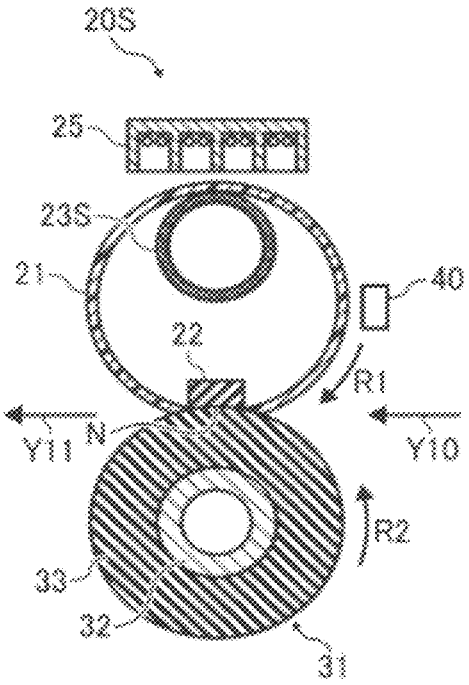
FIG. 7A is a vertical sectional view of a fixing device as a first variation of the fixing device shown in FIG. 2.
Figure 7B:
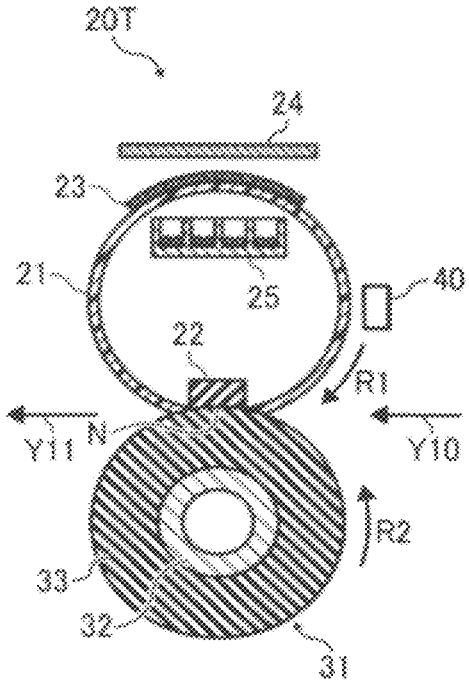
FIG. 7B is a vertical sectional view of a fixing device as a second variation of the fixing device shown in FIG. 2.

Referring to FIGS. 7A and 7B, the following describes variations of the fixing device 20 according to the first illustrative embodiment.

FIG. 7A is a vertical sectional view of a fixing device 20S that employs a tubular heat generator 23S instead of the arc-shaped heat generator 23 depicted in FIG. 2 as a first variation of the fixing device 20. FIG. 7B is a vertical sectional view of a fixing device 20T that employs the heat generator 23, the shield 24, and the exciting coil unit 25 disposed at positions different from those of the fixing device 20 depicted in FIG. 2 as a second variation of the fixing device 20.

According to the first illustrative embodiment described above, the fixing device 20 employs the substantially semi-cylindrical heat generator 23 as shown in FIG. 2. Alternatively, the heat generator may be cylindrical as shown in FIG. 7A. As illustrated in FIG. 7A, the cylindrical heat generator 23S contacts the inner circumferential surface of the fixing belt 21.

Further, the heat generator may be disposed outside the loop formed by the fixing belt 21 as shown in FIG. 7B. Specifically, as illustrated in FIG. 2, the fixing device 20 according to the first illustrative embodiment employs the heat generator 23 that contacts the inner circumferential surface of the fixing belt 21 and the exciting coil unit 25 that faces the outer circumferential surface of the fixing belt 21. Alternatively, as illustrated in FIG. 7B, the heat generator 23 may contact the outer circumferential surface of the fixing belt 21; the exciting coil unit 25 may face the inner circumferential surface of the fixing belt 21; and the shield 24 may be disposed outside the loop formed by the fixing belt 21 in such a manner that the heat generator 23 is disposed between the shield 24 and the fixing belt 21.

The configurations of the fixing devices 20S and 20T also switch between the first heating state and the second heating state by controlling the exciting coil unit 25 to change the density of a magnetic flux applied therefrom to the first heat generation layer 21*a* of the fixing belt 21, thus attaining the advantages of the configuration of the fixing device 20 shown in FIG. 2.

The fixing devices 20, 20S, and 20T may also employ the configurations according to second, third, and fourth illustrative embodiments described below.

As described above, the fixing devices 20, 20S, and 20T according to the first illustrative embodiment switch between the first heating state and the second heating state by controlling the exciting coil unit 25 to change the density of a magnetic flux applied therefrom to the first heat generation layer 21*a* of the fixing belt 21: the first heating state in which the magnetic flux generated by the exciting coil unit 25 heats only the first heat generation layer 21*a* of the fixing belt 21 by electromagnetic induction, thus heating the fixing belt 21; the second heating state in which the magnetic flux generated by the exciting coil unit 25 heats both the first heat generation layer 21*a* of the fixing belt 21 and the second heat generation layer 23*a* of the heat generator 23 by electromagnetic induction, thus heating the fixing belt 21 directly and at the same time heating the fixing belt 21 indirectly via the heat generator 23. That is, the fixing belt 21 is heated efficiently within a shortened period of time.

Referring to FIGS. 8A to 11B, the following describes fixing devices 20U and 20U' according to a second illustrative embodiment of the present invention.

Figure 8A:
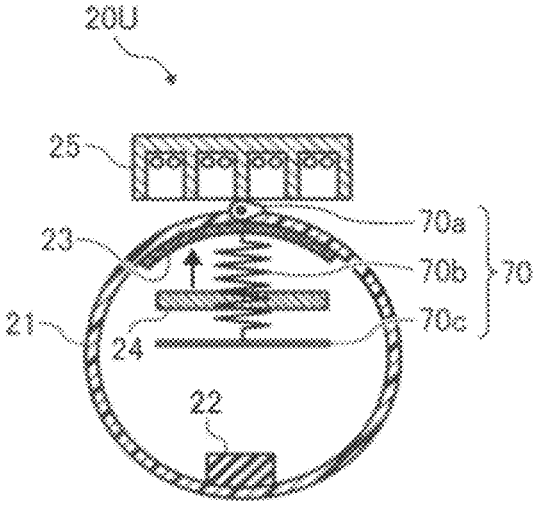
FIG. 8A is a vertical sectional view of a fixing device according to a second exemplary embodiment of the present invention.
Figure 8B:
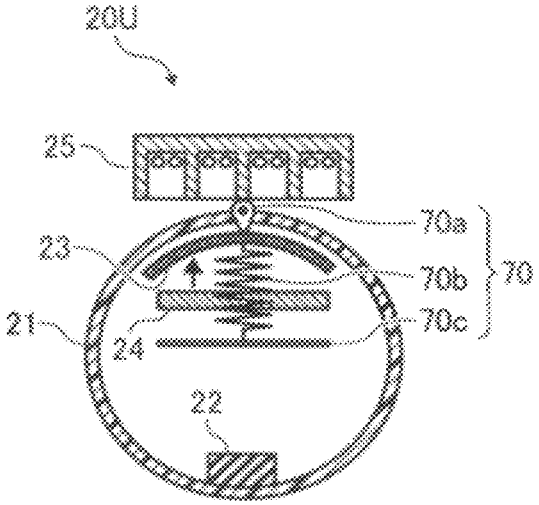
FIG. 8B is a vertical sectional view of the fixing device shown in FIG. 8A illustrating a heat generator separator that separates a heat generator from a fixing belt installed in the fixing device.
Figure 9:
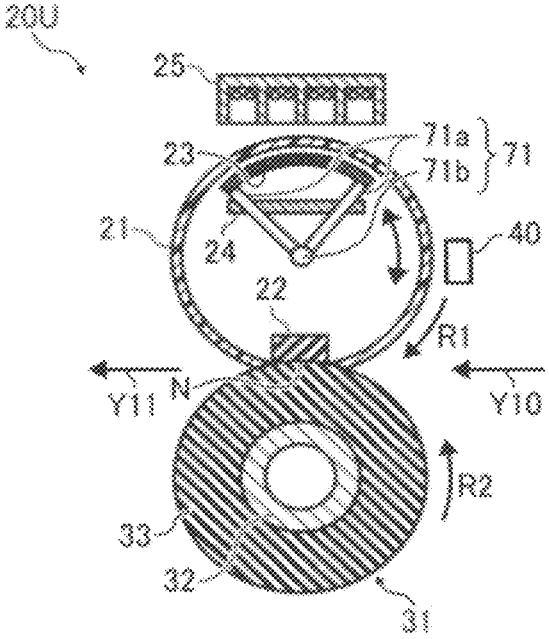
FIG. 9 is a vertical sectional view of the fixing device shown in FIG. 8B illustrating a heat generator moving assembly installed therein.
Figure 10A:
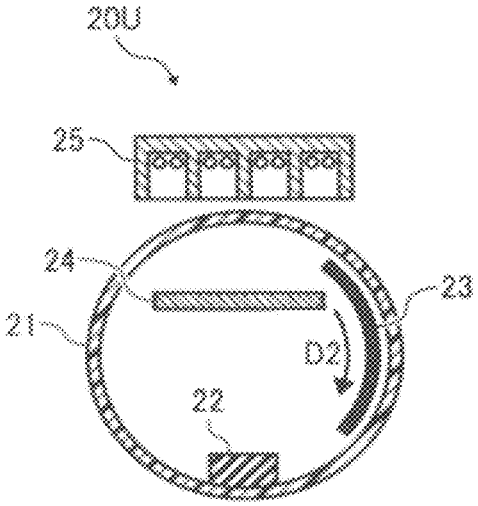
FIG. 10A is an enlarged vertical sectional view of the fixing device shown in FIG. 9 showing a heat generator installed therein in a state in which the heat generator is not disposed opposite an exciting coil unit.
Figure 10B:
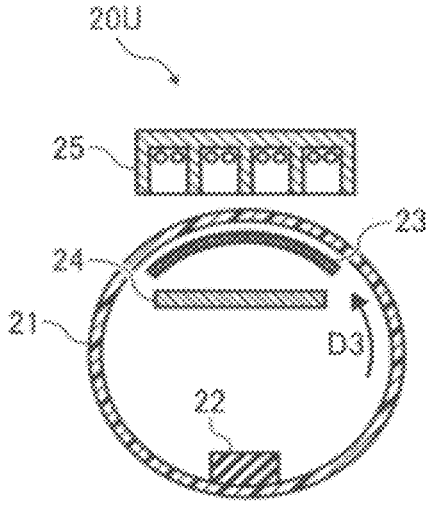
FIG. 10B is an enlarged vertical sectional view of the fixing device shown in FIG. 9 showing a heat generator installed therein in a state in which the heat generator is disposed opposite an exciting coil unit but isolated from a fixing belt.
Figure 10C:
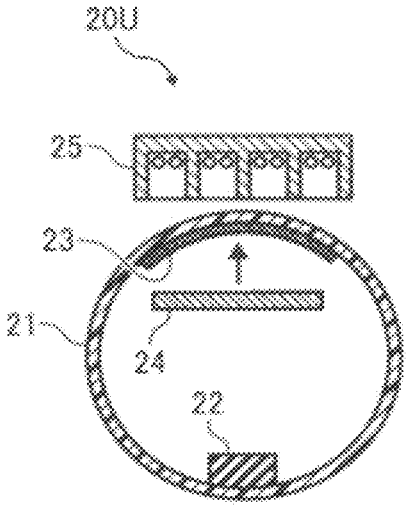
FIG. 10C is an enlarged vertical sectional view of the fixing device shown in FIG. 9 showing a heat generator installed therein in a state in which the heat generator is disposed opposite an exciting coil unit and in contact with a fixing belt.
Figure 11A:
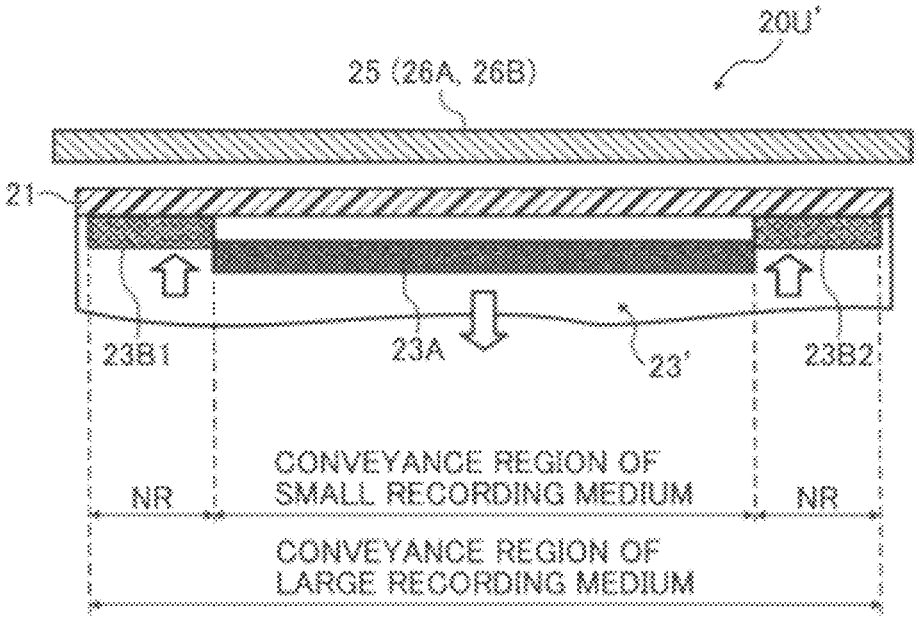
FIG. 11A is a horizontal sectional view of a fixing device as one variation of the fixing device shown in FIG. 9.
Figure 11B:
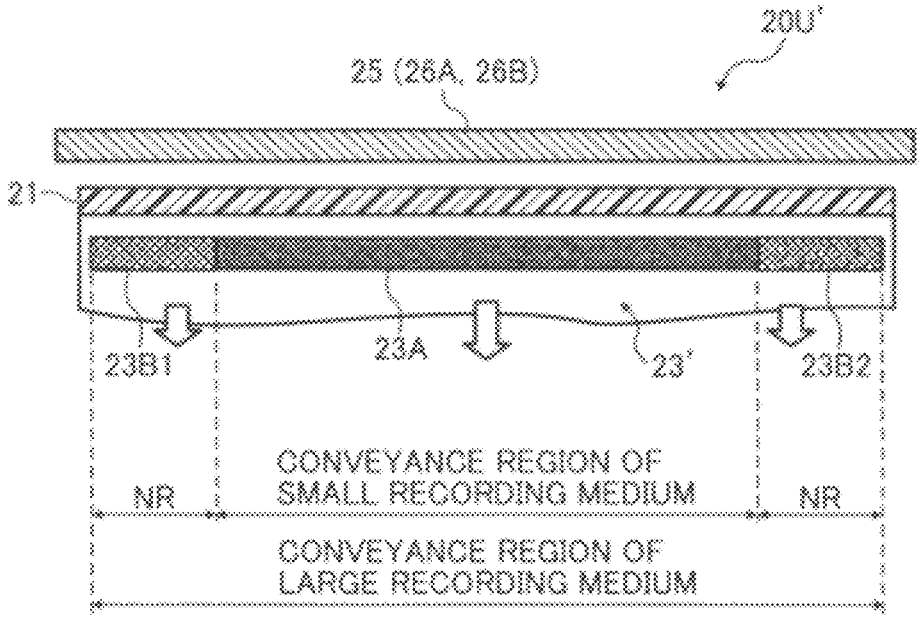
FIG. 11B is a horizontal sectional view of the fixing device shown in FIG. 11A when a large recording medium is conveyed through the fixing device.

FIGS. 8A and 8B illustrate a vertical sectional view of the fixing device 20U showing a heat generator separator 70 installed therein. FIG. 9 is a vertical sectional view of the fixing device 20U illustrating a heat generator moving assembly 71 installed therein. FIGS. 10A, 10B, and 10C illustrate an enlarged vertical sectional view of the fixing device 20U showing movement of the heat generator 23 moved by the heat generator moving assembly 71. FIGS. 11A and 11B illustrate a horizontal sectional view of the fixing device 20U' as one variation of the fixing device 20U.

Unlike the fixing device 20 shown in FIG. 2 according to the first illustrative embodiment in which the heat generator 23 constantly contacts the fixing belt 21, the fixing device 20U according to the second illustrative embodiment includes the heat generator 23 separable from the fixing belt 21.

As illustrated in FIG. 8A, like the fixing device 20 shown in FIG. 2, the fixing device 20U includes the fixing belt 21 formed into a loop, serving as a fixing rotary body that rotates in the rotation direction R1; the nip formation pad 22, the heat generator 23, and the shield 24, which are disposed inside the loop formed by the fixing belt 21; and the exciting coil unit 25, the pressing roller 31 serving as a pressing rotary body that rotates in the rotation direction R2 counter to the rotation direction R1 of the fixing belt 21, and the temperature sensor 40 serving as a temperature detector that detects the temperature of the fixing belt 21, which are disposed outside the loop formed by the fixing belt 21.

Further, like the fixing device 20 shown in FIG. 2, the exciting coil unit 25 of the fixing device 20U includes the two exciting coils, that is, the first exciting coil 26A and the second exciting coil 26B disposed opposite the fixing belt 21 in the different regions thereof, respectively. Thus, by changing the number of exciting coils connected to the alternating electric current power supply 61, that is, the first exciting coil 26A only or both the first exciting coil 26A and the second exciting coil 26B, the density of a magnetic flux applied from the exciting coil unit 25 to the first heat generation layer 21*a* of the fixing belt 21 is changed, thereby switching between the first heating state and the second heating state.

However, unlike the fixing device 20 shown in FIG. 2, the fixing device 20U has the heat generator separator 70 that separates the heat generator 23 from the fixing belt 21 at a predetermined time. When the heat generator 23 is isolated from the fixing belt 21 as shown in FIGS. 8B, 9, and 10B, the exciting coil unit 25 heats the first heat generation layer 21*a* of the fixing belt 21 in a third heating state. In the third heating state, even if a magnetic flux generated by the exciting coil unit 25 penetrates the first heat generation layer 21*a* of the fixing belt 21 and reaches the second heat generation layer 23*a* of the heat generator 23 isolated from the fixing belt 21, heating efficiency of the second heat generation layer 23*a* is decreased and at the same time heat is not conducted from the heat generator 23 to the fixing belt 21. Thus, the exciting coil unit 25 heats the fixing belt 21 in the third heating state at a predetermined time, fine-tuning heating of the fixing belt 21 by switching among the first heating state, the second heating state, and the third heating state.

For example, as shown in FIGS. 8A and 8B, the heat generator separator 70 includes a support 70*c* disposed inside the fixing belt 21; a spring 70*b* attached to the heat generator 23 and the support 70*c*; and a cam 70*a* contacting the exciting coil unit 25 and the heat generator 23.

The cam 70*a* is rotatably mounted on each of flanges provided on lateral ends of the fixing belt 21 in the axial direction thereof. When the cam 70*a* rotates clockwise in FIG. 8A, it lowers the heat generator 23 against a bias exerted by the spring 70*b* to the heat generator 23; thus the heat generator 23 moves downward to a position shown in FIG. 8B and separates from the fixing belt 21. Conversely, when the cam 70*a* rotates counterclockwise from the position shown in FIG. 8B, it lifts the heat generator 23; thus the heat generator 23 moves upward and returns to a position shown in FIG. 8A, contacting the fixing belt 21.

The fixing device 20U further includes the heat generator moving assembly 71 that rotates the heat generator 23 bidirectionally as indicated by the two-headed arrow in FIG. 9 in the circumferential direction of the fixing belt 21 between an opposed position shown in FIG. 10B where the heat generator 23 is disposed opposite the exciting coil unit 25 via the fixing belt 21 and a non-opposed position shown in FIG. 10A where the heat generator 23 is not disposed opposite the exciting coil unit 25. For example, the heat generator moving assembly 71 shown in FIG. 9 rotates the heat generator 23 in a direction D2 to the non-opposed position shown in FIG. 10A and in a direction D3 to the opposed position shown in FIG. 10B. When the heat generator 23 is at the non-opposed position shown in FIG. 10A, the magnetic flux generated by the exciting coil unit 25 does not reach the heat generator 23. It is effective to move the heat generator 23 to the non-opposed position shown in FIG. 10A to prevent the heat generator 23 from being heated by the magnetic flux from the exciting coil unit 25.

Referring to FIG. 9, the following describes the structure of the heat generator moving assembly 71 that rotates the heat generator 23 as described above.

As illustrated in FIG. 9, the heat generator moving assembly 71 includes a shaft 71*b* rotatably mounted on each of the flanges provided on the lateral ends of the fixing belt 21 in the axial direction thereof; and a support 71*a* attached to the heat generator 23 and the shaft 71*b*. The shaft 71*b* is mounted with a gear engaging a gear train connected to a driver (e.g., a motor). As the driver rotates the shaft 71*b*, the support 71*a* mounted on the shaft 71*b* rotates the heat generator 23 clockwise or counterclockwise in FIG. 9.

Referring to FIGS. 9, 10A, 10B, and 10C, the following describes movement of the heat generator 23 with the heat generator moving assembly 71 and the heat generator separator 70 described above to switch among the first heating state, the second heating state, and the third heating state.

While the fixing device 20U or the image forming apparatus 1 depicted in FIG. 1 installed with the fixing device 20U is warmed up, the controller 6 depicted in FIG. 2 operatively connected to the heat generator separator 70 and the heat generator moving assembly 71 controls the heat generator separator 70 and the heat generator moving assembly 71 to move the heat generator 23 to the non-opposed position shown in FIG. 1 OA where the heat generator 23 is not disposed opposite the exciting coil unit 25 in the first heating state or to the opposed position shown in FIG. 1 OB where the heat generator 23 is disposed opposite the exciting coil unit 25 without contacting the fixing belt 21 in the third heating state, thus causing the exciting coil unit 25 to heat the first heat generation layer 21*a* depicted in FIG. 3A of the fixing belt 21 only. Accordingly, even when the image forming apparatus 1 is cool in the morning after it has been powered off for a long time, the fixing belt 21 is heated to a desired fixing temperature quickly because the magnetic flux generated by the exciting coil unit 25 is concentrated on the first heat generation layer 21*a* of the fixing belt 21 only. Moreover, since the heat generator 23 is isolated from the fixing belt 21, it does not draw heat from the fixing belt 21.

By contrast, when a recording medium P bearing a toner image T is conveyed through the fixing nip N formed between the fixing belt 21 and the pressing roller 31, the controller 6 controls the heat generator separator 70 and the heat generator moving assembly 71 to move the heat generator 23 to the opposed position shown in FIG. 10C where the heat generator 23 is disposed opposite the exciting coil unit 25 by contacting the fixing belt 21 in the second heating state in which the exciting coil unit 25 heats both the first heat generation layer 21*a* of the fixing belt 21 and the second heat generation layer 23*a* of the heat generator 23. It is to be noted that, in the second heating state, the exciting coil unit 25 heats the second heat generation layer 23*a* of the heat generator 23 by electromagnetic induction. Namely, after the fixing belt 21 is warmed up, the exciting coil unit 25 heats the fixing belt 21 in the second heating state to conduct heat generated by the heat generator 23 to the fixing belt 21, thus heating the fixing belt 21 supplementarily to offset the temperature decrease of the fixing belt 21 caused by the recording medium P that draws heat from the fixing belt 21.

Referring to FIGS. 10A to 10C, the following describes examples of a control method for controlling the heat generator separator 70.

A first example of the control method is to control the heat generator separator 70 according to the temperature of the fixing belt 21.

For example, when the controller 6 depicted in FIG. 2 determines that the temperature of the fixing belt 21 detected by the temperature sensor 40 is lower than a predetermined temperature, the controller 6 controls the heat generator separator 70 depicted in FIG. 8A to move the heat generator 23 from the position shown in FIG. 10B where it is isolated from the fixing belt 21 to the position shown in FIG. 10C where it contacts the fixing belt 21.

Conversely, when the controller 6 determines that the temperature of the fixing belt 21 detected by the temperature sensor 40 is not lower than the predetermined temperature, the controller 6 controls the heat generator separator 70 to move the heat generator 23 from the position shown in FIG. 10C where it contacts the fixing belt 21 to the position shown in FIG. 10B where it is isolated from the fixing belt 21.

With the above-described control that moves the heat generator 23 from the position shown in FIG. 10B to the position illustrated in FIG. 10C, even when the temperature of the fixing belt 21 is decreased by the recording medium P that draws heat from the fixing belt 21 as the recording medium P passes over the fixing belt 21 at the fixing nip N, the heat generator 23 contacting the fixing belt 21 heats the fixing belt 21, offsetting the decrease of the temperature of the fixing belt 21 and minimizing formation of a faulty toner image due to the decreased temperature of the fixing belt 21. Conversely, when the temperature of the fixing belt 21 is not decreased, the heat generator separator 70 isolates the heat generator 23 from the fixing belt 21; thus the heat generator 23 stores heat generated by the second heat generation layer 23*a* by electromagnetic induction.

It is to be noted that the above-described control can also be performed when a plurality of recording media P is conveyed through the fixing nip N continuously.

A second example of the control method is to control the heat generator separator 70 according to the type of the recording medium P.

For example, the controller 6 controls the heat generator separator 70 to isolate the heat generator 23 from the fixing belt 21 as shown in FIG. 10B when a thin recording medium P having a thickness not greater than a predetermined thickness is conveyed through the fixing nip N. Since the thin recording medium P draws a relatively small amount of heat from the fixing belt 21, the temperature of the fixing belt 21 is maintained at the desired fixing temperature even without heat conduction from the heat generator 23 that contacts the fixing belt 21. The controller 6 may detect the type of the recording medium P (e.g., thin, plain, or thick paper) based on information contained in a print job sent from a client computer or input by the user by using the control panel of the image forming apparatus 1 depicted in FIG. 1.

A third example of the control method is to control the heat generator separator 70 according to the color of the toner image formed on the recording medium P.

The image forming apparatus 1 forms a monochrome toner image on a recording medium P. Alternatively, the image forming apparatus 1 may be configured to form both a monochrome toner image and a color toner image. When the controller 6 determines that a monochrome mode to form a monochrome toner image is selected, the controller 6 controls the heat generator separator 70 to isolate the heat generator 23 from the fixing belt 21 as shown in FIG. 10B. In the monochrome mode, the toner image on the recording medium P draws a smaller amount of heat from the fixing belt 21 than in a color mode to form a color toner image on the recording medium P. Accordingly, the temperature of the fixing belt 21 is maintained at the desired fixing temperature even without heat conduction from the heat generator 23 that contacts the fixing belt 21. Additionally, the above-described control of separating the heat generator 23 from the fixing belt 21 decreases wear of the fixing belt 21 due to friction between the heat generator 23 and the fixing belt 21 sliding over the heat generator 23. The controller 6 may detect the color of the toner image to be formed on the recording medium P based on information contained in a print job sent from a client computer or input by the user by using the control panel of the image forming apparatus 1.

A fourth example of the control method is to control the heat generator separator 70 according to the fixing temperature of the fixing belt 21.

For example, the image forming apparatus 1 may provide a high temperature mode having a first target fixing temperature of the fixing belt 21 and a low temperature mode having a second target fixing temperature of the fixing belt 21 that is lower than the first target fixing temperature. The high temperature mode is used for a thick recording medium P; the low temperature mode is used for a thin recording medium P. In the low temperature mode, the controller 6 controls the heat generator separator 70 to move the heat generator 23 to the position shown in FIG. 10B where the heat generator 23 is isolated from the fixing belt 21, thus heating the fixing belt 21 in the third heating state.

Specifically, if the heat generator 23 contacts the fixing belt 21 even when the image forming apparatus 1 switches from the high temperature mode to the low temperature mode, heat is conducted from the heat generator 23 to the fixing belt 21. Accordingly, it takes longer to lower the temperature of the fixing belt 21 to the second target fixing temperature of the low temperature mode. To address this problem, when the image forming apparatus 1 switches from the high temperature mode to the low temperature mode, the heat generator separator 70 separates the heat generator 23 from the fixing belt 21 as shown in FIG. 10B, shortening a transition time from the high temperature mode to the low temperature mode.

A fifth example of the control method is to control the heat generator separator 70 to prevent overheating of the fixing belt 21.

For example, when the temperature sensor 40 detects overheating of the fixing belt 21, that is, when the temperature of the fixing belt 21 exceeds a predetermined temperature while the heat generator 23 contacts the fixing belt 21 as shown in FIG. 10C, the controller 6 controls the heat generator separator 70 to separate the heat generator 23 from the fixing belt 21 as shown in FIG. 10B, preventing heat conduction from the heat generator 23 to the fixing belt 21 and thus facilitating cooling of the fixing belt 21.

Conversely, when the temperature sensor 40 detects overheating of the fixing belt 21, that is, when the temperature of the fixing belt 21 exceeds a predetermined temperature while the heat generator 23 is isolated from the fixing belt 21 as shown in FIG. 10B, the controller 6 controls the heat generator separator 70 to cause the heat generator 23 to contact the fixing belt 21 as shown in FIG. 10C, allowing the heat generator 23 to draw heat from the fixing belt 21 and thus facilitating cooling of the fixing belt 21.

A sixth example of the control method is to control the heat generator separator 70 according to the conveyance speed of the recording medium P.

For example, if the fixing device 20U is installed in the image forming apparatus 1 configured to convey the recording medium P at a relatively low speed, that is, if the fixing device 20U is installed in an image forming apparatus having a lower print productivity as a common unit, the controller 6 controls the heat generator separator 70 to keep the heat generator 23 isolated from the fixing belt 21 as shown in FIG. 10B.

Specifically, the recording medium P conveyed at a lower speed draws a smaller amount of heat from the fixing belt 21 than the recording medium P conveyed at a higher speed. Accordingly, the temperature of the fixing belt 21 is maintained without heat conduction from the heat generator 23 to the fixing belt 21 that contacts the heat generator 23. With this control method, the fixing device 20U is used in various image forming apparatuses that convey the recording medium P at various speeds.

Referring to FIGS. 11A and 11B, a description is now given of the fixing device 20U' as one variation of the fixing device 20U according to the second illustrative embodiment.

As illustrated in FIGS. 11A and 11B, the fixing device 20U' includes a heat generator 23' divided into a plurality of parts that corresponds to the size of the recording medium P so that the heat generator separator 70 separates the plurality of parts of the heat generator 23' from the fixing belt 21 according to the width of the recording medium P conveyed through the fixing nip N.

For example, the heat generator 23' is divided into three parts: a center heat generator 23A disposed at a center of the heat generator 23' in the axial direction of the fixing belt 21; a first lateral end heat generator 23B1 disposed at one lateral end of the heat generator 23' in the axial direction of the fixing belt 21; and a second lateral end heat generator 23B2 disposed at another lateral end of the heat generator 23' in the axial direction of the fixing belt 21. The width of the center heat generator 23A corresponds to the width of a small recording medium P. The combined width of the center heat generator 23A, the first lateral end heat generator 23B1, and the second lateral end heat generator 23B2 corresponds to the width of a large recording medium P. The heat generator separator 70 moves the center heat generator 23A, the first lateral end heat generator 23B1, and the second lateral end heat generator 23B2 with respect to the fixing belt 21 independently according to the size of the recording medium P conveyed to the fixing nip N. Accordingly, even when the small recording medium P is conveyed through the fixing nip N, the non-conveyance regions NR on the fixing belt 21 are not overheated due to absence of the recording medium P that draws heat from the non-conveyance regions NR on the fixing belt 21.

It is to be noted that the controller 6 depicted in FIG. 1 may detect the size of the recording medium P based on information contained in the image data generated by the original document reader 2, information contained in a print job sent from a client computer, or information contained in a print job input by the user by using the control panel of the image forming apparatus 1.

For example, when a small recording medium P, that is, a recording medium having a width in the axial direction of the fixing belt 21 not greater than a predetermined width, is conveyed through the fixing nip N immediately after a plurality of large recording media P, that is, recording media having a width in the axial direction of the fixing belt 21 greater than the predetermined width, passes through the fixing nip N continuously in a state in which all of the center heat generator 23A, the first lateral end heat generator 23B1, and the second lateral end heat generator 23B2 is isolated from the fixing belt 21 as shown in FIG. 11B, the small recording medium P does not draw heat from the non-conveyance regions NR disposed in the lateral ends of the fixing belt 21 in the axial direction thereof, thus overheating the conveyance regions NR on the fixing belt 21. To address this problem, the first lateral end heat generator 23B1 and the second lateral end heat generator 23B2 contact the non-conveyance regions NR on the fixing belt 21, respectively, as shown in FIG. 11A. Accordingly, the first lateral end heat generator 23B1 and the second lateral end heat generator 23B2 draw heat from the non-conveyance regions NR on the fixing belt 21, preventing overheating of the non-conveyance regions NR on the fixing belt 21.

It is to be noted that the above-described movement of the first lateral end heat generator 23B1 and the second lateral end heat generator 23B2 is one example, and therefore the center heat generator 23A, the first lateral end heat generator 23B1, and the second lateral end heat generator 23B2 may move independently according to various conditions. Further, the heat generator 23' is divided into three parts as shown in FIGS. 11A and 11B as the center heat generator 23A, the first lateral end heat generator 23B1, and the second lateral end heat generator 23B2 that correspond to two sizes of the recording medium P, that is, a small recording medium P and a large recording medium P. Alternatively, the heat generator 23' may be divided into five parts or more that correspond to three or more sizes of the recording medium P, for example.

As described above, like the fixing devices 20, 20S, and 20T according to the first illustrative embodiment, the fixing devices 20U and 20U' according to the second illustrative embodiment change the density of a magnetic flux applied from the exciting coil unit 25 to the first heat generation layer 21*a* of the fixing belt 21, switching between the first heating state in which the exciting coil unit 25 heats only the first heat generation layer 21*a* of the fixing belt 21 by electromagnetic induction, thus heating the fixing belt 21 and the second heating state in which the exciting coil unit 25 heats both the first heat generation layer 21*a* of the fixing belt 21 and the second heat generation layer 23*a* of the heat generator 23 or 23' by electromagnetic induction, thus heating the fixing belt 21 directly and at the same time heating the fixing belt 21 indirectly via the heat generator 23 or 23'. Accordingly, the fixing belt 21 is heated to the desired fixing temperature by electromagnetic induction with improved heating efficiency within a shortened period of time.

Figure 12:
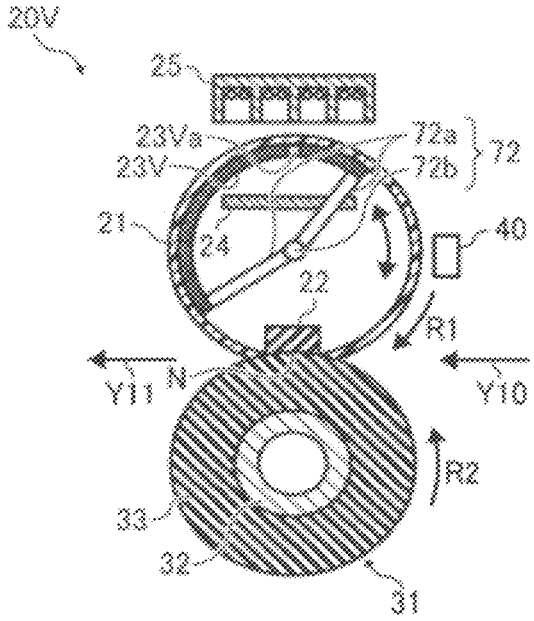
FIG. 12 is a vertical sectional view of a fixing device according to a third exemplary embodiment of the present invention.

Referring to FIG. 12, the following describes a fixing device 20V according to a third illustrative embodiment of the present invention.

FIG. 12 is a vertical sectional view of the fixing device 20V. Unlike the fixing device 20 shown in FIG. 2 according to the first illustrative embodiment, the fixing device 20V according to the third illustrative embodiment includes a heat generator 23V having a slit 23Va serving as a nonconductive portion.

As illustrated in FIG. 12, like the fixing device 20 shown in FIG. 2, the fixing device 20V includes the fixing belt 21 formed into a loop, serving as a fixing rotary body that rotates in the rotation direction R1; the nip formation pad 22, the heat generator 23V, and the shield 24, which are disposed inside the loop formed by the fixing belt 21; and the exciting coil unit 25, the pressing roller 31 serving as a pressing rotary body that rotates in the rotation direction R2 counter to the rotation direction R1 of the fixing belt 21, and the temperature sensor 40 serving as a temperature detector that detects the temperature of the fixing belt 21, which are disposed outside the loop formed by the fixing belt 21.

Further, like the fixing device 20 shown in FIG. 2, the exciting coil unit 25 of the fixing device 20V includes the two exciting coils, that is, the first exciting coil 26A and the second exciting coil 26B disposed opposite the fixing belt 21 in the different regions thereof, respectively. Thus, by changing the number of exciting coils connected to the alternating electric current power supply 61, that is, the first exciting coil 26A only or both the first exciting coil 26A and the second exciting coil 26B, the density of a magnetic flux applied from the exciting coil unit 25 to the first heat generation layer 21*a* of the fixing belt 21 is changed, thereby switching between the first heating state and the second heating state.

However, unlike the fixing device 20 shown in FIG. 2, the fixing device 20V has the heat generator 23V provided with the slit 23Va (e.g., a through-hole) serving as a nonconductive portion extending in the axial direction of the fixing belt 21 along a passing direction of an eddy current induced to the second heat generation layer 23*a* of the heat generator 23V.

The fixing device 20V further includes a heat generator moving assembly 72 that moves the heat generator 23V bidirectionally as indicated by the two-headed arrow in FIG. 12 in the circumferential direction of the fixing belt 21, moving the slit 23Va disposed opposite the exciting coil unit 25 via the fixing belt 21 and thereby changing an amount of heat generated by the second heat generation layer 23*a* of the heat generator 23V by electromagnetic induction.

The slit 23Va is disposed at a part of the heat generator 23V in a circumferential direction thereof and extends throughout substantially the entire width of the heat generator 23V in the axial direction of the fixing belt 21. The heat generator moving assembly 72 rotates the heat generator 23V bidirectionally as indicated by the two-headed arrow in FIG. 12 along the inner circumferential surface of the fixing belt 21.

For example, the heat generator moving assembly 72 includes a shaft 72*b* rotatably mounted on each of the flanges provided on the lateral ends of the fixing belt 21 in the axial direction thereof; and a support 72*a* attached to the heat generator 23V and the shaft 72*b*. The shaft 72*b* is mounted with a gear engaging a gear train connected to a driver (e.g., a motor). As the driver rotates the shaft 72*b*, the support 72*a* mounted on the shaft 72*b* rotates the heat generator 23V clockwise or counterclockwise in FIG. 12.

In order to minimize an amount of heat generated by the second heat generation layer 23*a* of the heat generator 23V heated by the exciting coil unit 25, the heat generator moving assembly 72 rotates the heat generator 23V to an opposed position shown in FIG. 12 where the slit 23Va is disposed opposite a center of the exciting coil unit 25 in the rotation direction R1 of the fixing belt 21. Accordingly, only a small magnetic path generates in proximity to the slit 23Va that sidesteps the slit 23Va, decreasing the amount of heat generated by the heat generator 23V.

By contrast, in order to increase the amount of heat generated by the second heat generation layer 23*a* of the heat generator 23V heated by the exciting coil unit 25, the heat generator moving assembly 72 rotates the heat generator 23V clockwise in FIG. 12 to a non-opposed position where the slit 23Va is not disposed opposite the exciting coil unit 25. Accordingly, a relatively great magnetic path generates in the heat generator 23V, increasing the amount of heat generated by the heat generator 23V.

Such operation of the heat generator moving assembly 72 that changes the amount of heat generated by the heat generator 23V fine-tunes heating of the fixing belt 21.

Referring to FIGS. 13A, 13B, 14A, and 14B, the following describes a fixing device 20V' including a heat generator 23V' as one variation of the heat generator 23V.

Figure 13A:
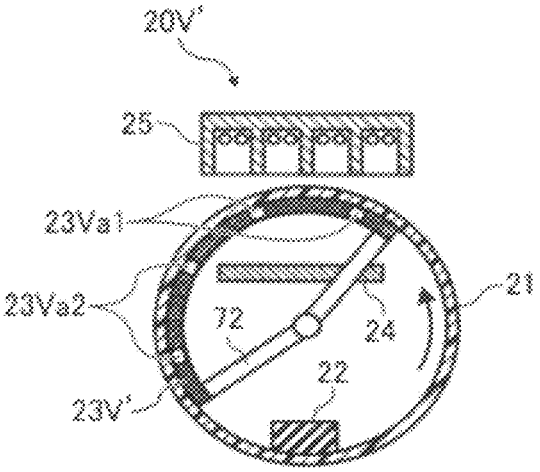
FIG. 13A is a partial vertical sectional view of a fixing device as one variation of the fixing device shown in FIG. 12 in a state in which a heat generator installed therein is at a first opposed position.
Figure 13B:
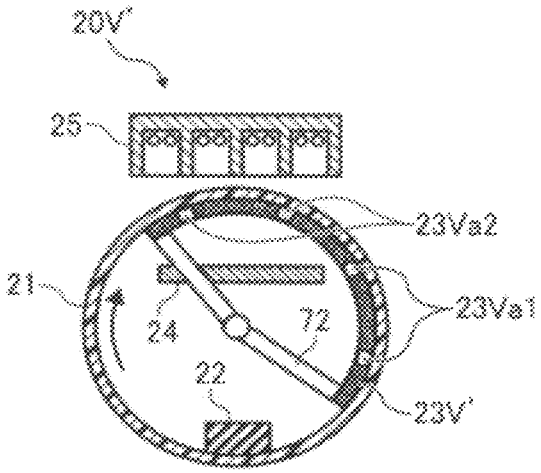
FIG. 13B is a partial vertical sectional view of the fixing device shown in FIG. 13A in a state in which the heat generator is at a second opposed position.
Figure 14A:
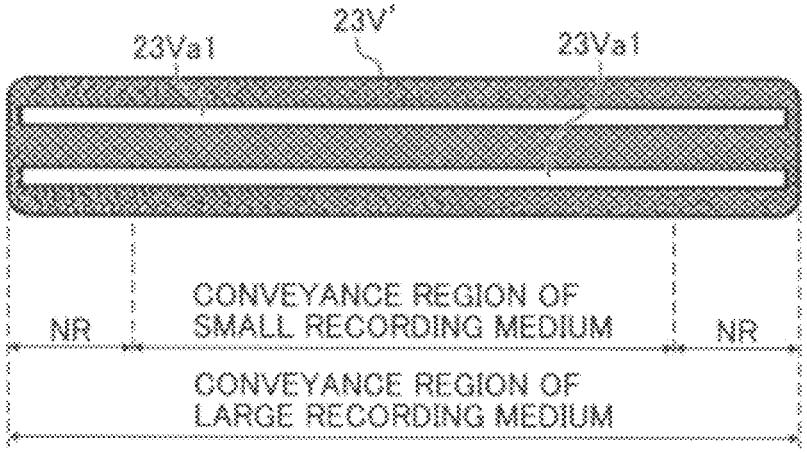
FIG. 14A is a top view of the heat generator shown in FIG. 13A.
Figure 14B:
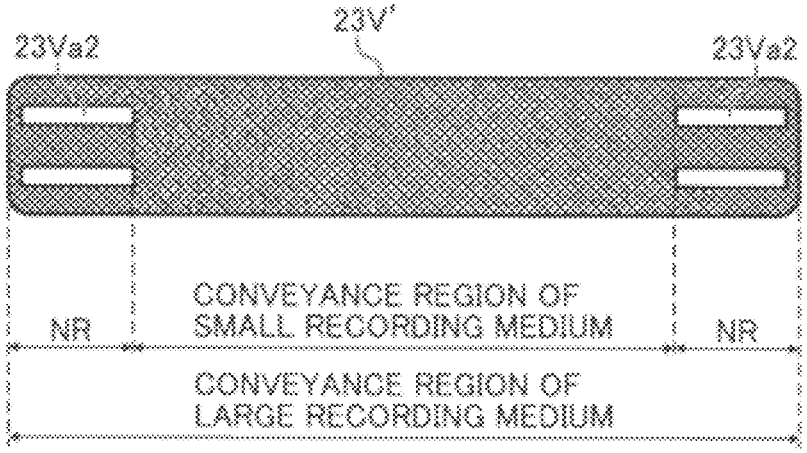
FIG. 14B is a top view of the heat generator shown in FIG. 13B.

FIG. 13A is a partial vertical sectional view of the fixing device 20V' in a state in which the heat generator 23V' is at a first opposed position. FIG. 13B is a partial vertical sectional view of the fixing device 20V' in a state in which the heat generator 23V' is at a second opposed position. FIG. 14A is a top view of the heat generator 23V' disposed opposite the exciting coil unit 25 in a state in which the heat generator 23V' is at the first opposed position. FIG. 14B is a top view of the heat generator 23V' disposed opposite the exciting coil unit 25 in a state in which the heat generator 23V' is at the second opposed position.

As illustrated in FIGS. 13A and 13B, the heat generator 23V' includes a plurality of slits, that is, first slits 23Va1 and second slits 23Va2, serving as nonconductive portions disposed in correspondence to recording media P of various sizes. Like the fixing device 20V shown in FIG. 12, the fixing device 20V' also includes the heat generator moving assembly 72 that rotates the heat generator 23V' bidirectionally in the circumferential direction of the fixing belt 21. The controller 6 depicted in FIG. 2 operatively connected to the heat generator moving assembly 72 selects slits to be disposed opposite the exciting coil unit 25 from among the first slits 23Va1 and the second slits 23Va2 according to the size, that is, the width, of a recording medium P in the axial direction of the fixing belt 21 to be conveyed to the fixing nip N and then the heat generator moving assembly 72 rotates the heat generator 23V' to stop the selected slits at opposed positions where they are disposed opposite the exciting coil unit 25.

For example, as shown in FIGS. 13A and 14A, the first slits 23Va1 are disposed at two parts of the heat generator 23V' in a circumferential direction thereof and extend throughout substantially the entire width of the heat generator 23V' in the axial direction of the fixing belt 21 that corresponds to the width of a large recording medium P, that is, the conveyance region on the fixing belt 21 through which the large recording medium P is conveyed. Conversely, as shown in FIGS. 13B and 14B, the second slits 23Va2 are disposed at another two parts of the heat generator 23V' in the circumferential direction thereof and at lateral ends of the heat generator 23V' in the axial direction of the fixing belt 21 that correspond to the non-conveyance regions NR on the fixing belt 21 through which a small recording medium P is not conveyed.

The heat generator moving assembly 72 switchably rotates the heat generator 23V' to the first opposed position shown in FIG. 13A where the first slits 23Va1 are disposed opposite the exciting coil unit 25 and to the second opposed position shown in FIG. 13B where the second slits 23Va2 are disposed opposite the exciting coil unit 25. The heat generator moving assembly 72 switches the position of the heat generator 23V' between the first opposed position and the second opposed position according to the width of the recording medium P, thus minimizing overheating of the non-conveyance regions NR on the fixing belt 21 even if the small recording medium P is conveyed through the fixing nip N.

For example, the heat generator moving assembly 72 stops the heat generator 23V' at the first opposed position shown in FIG. 13A when the large recording medium P is conveyed through the fixing nip N. By contrast, the heat generator moving assembly 72 stops the heat generator 23V' at the second opposed position shown in FIG. 13B when the small recording medium P is conveyed through the fixing nip N.

When the heat generator 23V' is at the second opposed position where the second slits 23Va2 are disposed opposite the exciting coil unit 25, the second slits 23Va2 minimize the amount of heat generated by the heat generator 23V' at the lateral ends thereof corresponding to the non-conveyance regions NR on the fixing belt 21, respectively. Accordingly, a minimum amount of heat is conducted from the lateral ends of the heat generator 23V' to the non-conveyance regions NR on the fixing belt 21, preventing overheating of the lateral ends of the fixing belt 21 in the axial direction thereof.

It is to be noted that even when the large recording medium P is conveyed through the fixing nip N, the heat generator moving assembly 72 adjusts the position of the heat generator 23V' from the first opposed position shown in FIG. 13A where the first slits 23Va1 are disposed opposite the exciting coil unit 25, thus fine-tuning the amount of heat generated by the heat generator 23V' throughout the entire conveyance region of the fixing belt 21.

The heat generator 23V' is provided with two types of slits as the first slits 23Va1 and the second slits 23Va2 that correspond to two sizes of the recording medium P, that is, a small recording medium P and a large recording medium P. Alternatively, the heat generator 23V' may be provided with three or more types of slits that correspond to three or more sizes of recording media P, for example.

As described above, like the fixing devices 20, 20S, 20T, 20U, and 20U' according to the first and second illustrative embodiments, the fixing devices 20V and 20V' according to the third illustrative embodiment change the density of a magnetic flux applied from the exciting coil unit 25 to the first heat generation layer 21*a* of the fixing belt 21, switching between the first heating state in which the exciting coil unit 25 heats only the first heat generation layer 21*a* of the fixing belt 21 by electromagnetic induction, thus heating the fixing belt 21 and the second heating state in which the exciting coil unit 25 heats both the first heat generation layer 21*a* of the fixing belt 21 and the second heat generation layer 23*a* of the heat generator 23V or 23V' by electromagnetic induction, thus heating the fixing belt 21 directly and at the same time heating the fixing belt 21 indirectly via the heat generator 23V or 23V'. Accordingly, the fixing belt 21 is heated to the desired fixing temperature by electromagnetic induction with improved heating efficiency within a shortened period of time.

Figure 15:
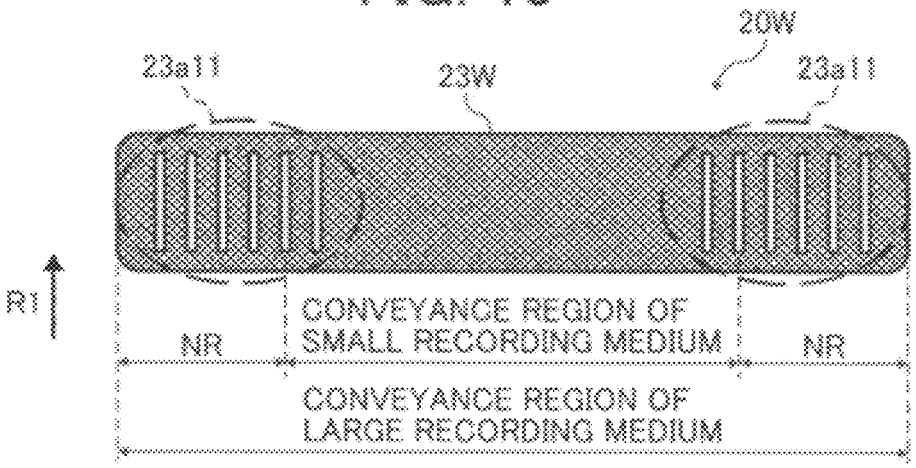
FIG. 15 is a top view of a heat generator installed in a fixing device according to a fourth exemplary embodiment of the present invention.

Referring to FIG. 15, the following describes a fixing device 20W including a heat generator 23W according to a fourth illustrative embodiment of the present invention.

FIG. 15 is a top view of the heat generator 23W. Unlike the fixing device 20V shown in FIG. 12 according to the third illustrative embodiment, the fixing device 20W according to the fourth illustrative embodiment includes the heat generator 23W that has slits 23*a*11 serving as nonconductive portions. For example, unlike the slit 23Va shown in FIG. 12 that extends in the passing direction of an eddy current induced to the second heat generation layer 23*a* of the heat generator 23V, the slits 23*a*11 shown in FIG. 15 extend in a direction orthogonal to the passing direction of an eddy current induced to the second heating generation layer 23*a* of the heat generator 23W.

Like the fixing device 20V shown in FIG. 12, the fixing device 20W includes the fixing belt 21 formed into a loop, serving as a fixing rotary body that rotates in the rotation direction R1; the nip formation pad 22, the heat generator 23W, and the shield 24, which are disposed inside the loop formed by the fixing belt 21; and the exciting coil unit 25, the pressing roller 31 serving as a pressing rotary body that rotates in the rotation direction R2 counter to the rotation direction R1 of the fixing belt 21, and the temperature sensor 40 serving as a temperature detector that detects the temperature of the fixing belt 21, which are disposed outside the loop formed by the fixing belt 21.

Further, like the fixing device 20 shown in FIG. 2, the exciting coil unit 25 of the fixing device 20W includes the two exciting coils, that is, the first exciting coil 26A and the second exciting coil 26B disposed opposite the fixing belt 21 in the different regions thereof, respectively. Thus, by changing the number of exciting coils connected to the alternating electric current power supply 61, that is, the first exciting coil 26A only or both the first exciting coil 26A and the second exciting coil 26B, the density of a magnetic flux applied from the exciting coil unit 25 to the first heat generation layer 21*a* of the fixing belt 21 is changed, thereby switching between the first heating state and the second heating state.

However, unlike the fixing device 20V shown in FIG. 12, the fixing device 20W has the heat generator 23W provided with the slits 23*a*11 (e.g., through-holes) serving as nonconductive portions extending in the direction orthogonal to the passing direction of an eddy current induced to the second heat generation layer 23*a* of the heat generator 23W.

For example, as shown in FIG. 15, the plurality of slits 23*a*11 extending in a direction parallel to the rotation direction R1 of the fixing belt 21 is disposed at lateral ends of the heat generator 23W in the axial direction of the fixing belt 21 that correspond to the non-conveyance regions NR on the fixing belt 21 through which a small recording medium P is not conveyed. The slits 23*a*11 extending in the direction orthogonal to the passing direction of an eddy current induced to the second heat generation layer 23*a* of the heat generator 23W prevent a magnetic flux generated by the exciting coil unit 25 from leaking across the slits 23*a*11 in the axial direction of the fixing belt 21, thus preventing temperature decrease of the lateral ends of the heat generator 23W. If the slits 23*a*11 are disposed only at the lateral ends of the heat generator 23W as shown in FIG. 15, the slits 23*a*11 also prevent overheating of the non-conveyance regions NR on the fixing belt 21 when small recording media P are conveyed through the fixing nip N continuously.

Figure 16A:
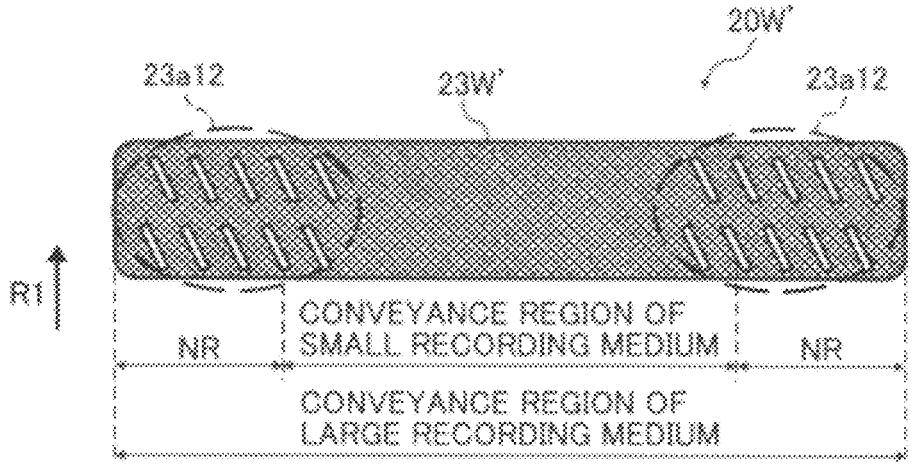
FIG. 16A is a top view of a heat generator as one variation of the heat generator shown in FIG. 15.

Referring to FIG. 16A, the following describes a fixing device 20W' including a heat generator 23W' as one variation of the heat generator 23W.

FIG. 16A is a top view of the heat generator 23W'. As illustrated in FIG. 16A, the heat generator 23W' includes a plurality of slits 23*a*12 slanting with respect to the rotation direction R1 of the fixing belt 21, not being parallel to the rotation direction R1, disposed at lateral ends of the heat generator 23W' in the axial direction of the fixing belt 21. The slits 23*a*12 prevent temperature decrease of the lateral ends of the heat generator 23W' corresponding to the non-conveyance regions NR on the fixing belt 21 and at the same time provide a uniform amount of heat generated by the heat generator 23W' throughout the axial direction of the fixing belt 21.

Figure 16B:
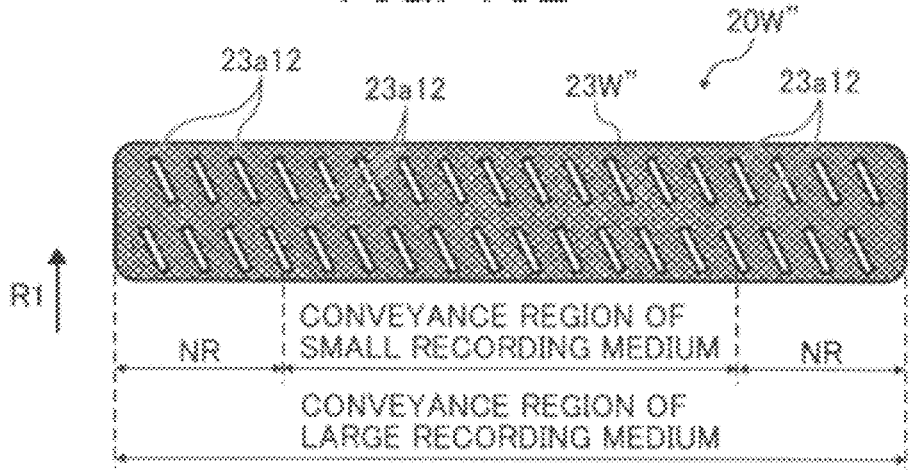
FIG. 16B is a top view of a heat generator as another variation of the heat generator shown in FIG. 15.

Referring to FIG. 16B, the following describes a fixing device 20W" including a heat generator 23W" as another variation of the heat generator 23W.

FIG. 16B is a top view of the heat generator 23W". As illustrated in FIG. 16B, the heat generator 23W" includes a plurality of slits 23*a*12 slanting with respect to the rotation direction R1 of the fixing belt 21, disposed substantially the entire region of the heat generator 23W" in the axial direction of the fixing belt 21. Although the slits 23*a*12 of the fixing device 20W" cause the entire heat generator 23W" to generate a smaller amount of heat than that of a heat generator without the slits 23*a*12, the slits 23*a*12 of the fixing device 20W"

provide a uniform amount of heat generated by the heat generator 23W" throughout the axial direction of the fixing belt 21.

As described above, like the fixing devices 20, 20S, 20T, 20U, 20U', 20V, and 20V' according to the first, second, and third illustrative embodiments, the fixing devices 20W, 20W', and 20W" according to the fourth illustrative embodiment change the density of a magnetic flux applied from the exciting coil unit 25 to the first heat generation layer 21*a* of the fixing belt 21, switching between the first heating state in which the exciting coil unit 25 heats only the first heat generation layer 21*a* of the fixing belt 21 by electromagnetic induction, thus heating the fixing belt 21 and the second heating state in which the exciting coil unit 25 heats both the first heat generation layer 21*a* of the fixing belt 21 and the second heat generation layer 23*a* of the heat generator 23W, 23W', or 23W" by electromagnetic induction, thus heating the fixing belt 21 directly and at the same time heating the fixing belt 21 indirectly via the heat generator 23W, 23W', or 23W". Accordingly, the fixing belt 21 is heated to the desired fixing temperature by electromagnetic induction with improved heating efficiency within a shortened period of time.

Figure 17:
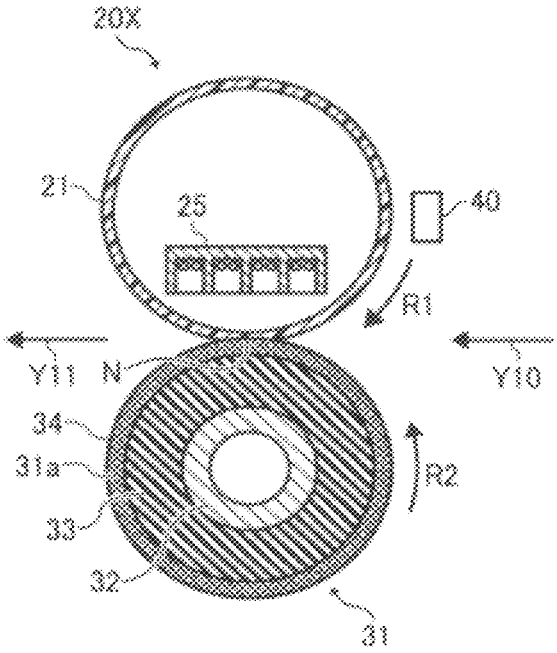
FIG. 17 is a vertical sectional view of a fixing device according to a fifth exemplary embodiment of the present invention.

Referring to FIG. 17, the following describes a fixing device 20X according to a fifth illustrative embodiment of the present invention.

FIG. 17 is a vertical sectional view of the fixing device 20X. The fixing device 20X is different from the fixing devices described above in that the heat generator is not disposed inside the fixing belt 21.

As illustrated in FIG. 17, the fixing device 20X includes the fixing belt 21, formed into a loop, serving as a fixing rotary body that rotates in the rotation direction R1; the exciting coil unit 25 disposed inside the loop formed by the fixing belt 21; the pressing roller 31, constructed of the metal core 32, the elastic layer 33, a second heat generation layer 31*a*, and a release layer 34 (e.g., a PFA tube), serving as a pressing rotary body that rotates in the rotation direction R2 counter to the rotation direction R1 of the fixing belt 21; and the temperature sensor 40 serving as a temperature detector that detects the temperature of the fixing belt 21. The pressing roller 31 and the temperature sensor 40 are disposed outside the loop formed by the fixing belt 21.

Since the fixing device 20X does not have the heat generator 23 depicted in FIG. 2, the pressing roller 31 includes the second heat generation layer 31*a* that generates heat by electromagnetic induction. Similar to the second heat generation layer 23*a* of the heat generator 23 depicted in FIG. 3B, the second heat generation layer 31*a* of the pressing roller 31 is also made of a conductive material; thus, the pressing roller 31 also serves as a heat generator that generates heat by a magnetic flux generated by the exciting coil unit 25 disposed opposite the pressing roller 31 via the fixing belt 21.

With this configuration of the fixing device 20X, similar to the fixing devices described above, the controller 6 depicted in FIG. 2 controls the exciting coil unit 25 to change the density of a magnetic flux generated therefrom and applied to the first heat generation layer 21*a* of the fixing belt 21, thus switching between the first heating state in which the exciting coil unit 25 heats only the first heat generation layer 21*a* depicted in FIG. 3A of the fixing belt 21 and the second heating state in which the exciting coil unit 25 heats both the first heat generation layer 21*a* of the fixing belt 21 and the second heat generation layer 31*a* of the pressing roller 31.

Figure 18:
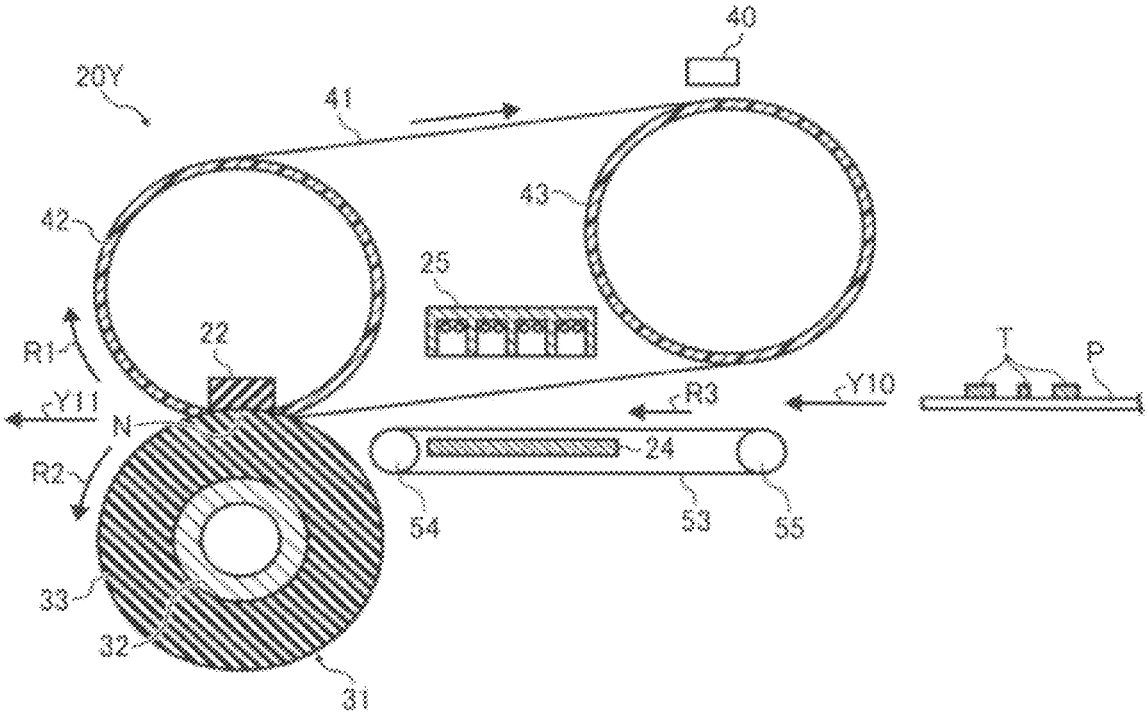
FIG. 18 is a vertical sectional view of a fixing device according to a sixth exemplary embodiment of the present invention.
Figure 19A:
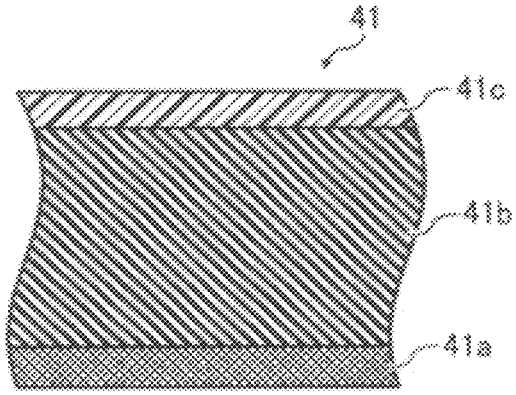
FIG. 19A is a partial vertical sectional view of a fixing belt installed in the fixing device shown in FIG. 18.
Figure 19B:
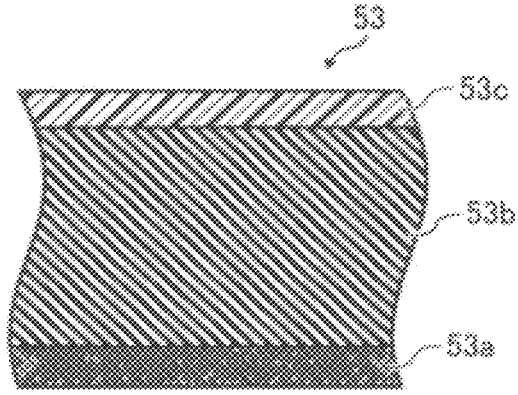
FIG. 19B is a partial vertical sectional view of a conveyance belt installed in the fixing device shown in FIG. 18.

Referring to FIGS. 18, 19A, and 19B, the following describes a fixing device 20Y according to a sixth illustrative embodiment of the present invention.

FIG. 18 is a vertical sectional view of the fixing device 20Y. FIG. 19A is a partial vertical sectional view of a fixing belt 41 installed in the fixing device 20Y. FIG. 19B is a partial vertical sectional view of a conveyance belt 53 installed in the fixing device 20Y.

As illustrated in FIG. 18, the fixing device 20Y includes the fixing belt 41, formed into an elliptic loop, serving as a fixing rotary body that rotates in the rotation direction R1; a fixing roller 42, a support roller 43, and the exciting coil unit 25, which are disposed inside the elliptic loop formed by the fixing belt 41; the nip formation pad 22 disposed inside the fixing roller 42; the pressing roller 31, constructed of the metal core 32 and the elastic layer 33, serving as a pressing rotary body that rotates in the rotation direction R2 counter to the rotation direction R1 of the fixing belt 41; the temperature sensor 40 serving as a temperature detector that detects the temperature of the fixing belt 41; the conveyance belt 53, formed into an elliptic loop, which conveys a recording medium P bearing a toner image T toward the fixing nip N formed between the nip formation pad 22 and the pressing roller 31 via the fixing roller 42 and the fixing belt 41; two rollers 54 and 55 that stretch and support the conveyance belt 53; and the shield 24 disposed inside the elliptic loop formed by the conveyance belt 53.

Specifically, the fixing belt 41 is stretched over and supported by the fixing roller 42 and the support roller 43. The pressing roller 31 presses against the nip formation pad 22 via the fixing belt 41 and the fixing roller 42 to form the fixing nip N between the pressing roller 31 and the fixing belt 41. The conveyance belt 53 is stretched over and supported by the two rollers 54 and 55; the roller 54 drives and rotates the conveyance belt 53 in a rotation direction R3 to feed the recording medium P conveyed in the direction Y10 toward the fixing nip N.

Similar to the fixing belt 21 depicted in FIG. 3A, as illustrated in FIG. 19A, the fixing belt 41 is constructed of multiple layers: a first heat generation layer 41*a* that generates heat by a magnetic flux generated by the exciting coil unit 25 by electromagnetic induction; an elastic layer 41*b* disposed on the first heat generation layer 41*a*; and a release layer 41*c* disposed on the elastic layer 41*b* as an outer layer contacting the recording medium P.

Since the fixing device 20Y does not have the heat generator 23 depicted in FIG. 2, the conveyance belt 53 includes a second heat generation layer 53*a* that generates heat by electromagnetic induction as shown in FIG. 19B. Like the fixing belt 21 shown in FIG. 3A, the conveyance belt 53 is constructed of multiple layers: the second heat generation layer 53*a* that generates heat by a magnetic flux generated by the exciting coil unit 25 by electromagnetic induction; an elastic layer 53*b* disposed on the second heat generation layer 53*a*; and a release layer 53*c* disposed on the elastic layer 53*b* as an outer layer contacting the recording medium P.

Similar to the second heat generation layer 23*a* of the heat generator 23 depicted in FIG. 3B, the second heat generation layer 53*a* of the conveyance belt 53 is also made of a conductive material; thus, the conveyance belt 53 serves as a heat generator that generates heat by a magnetic flux generated by the exciting coil unit 25 disposed opposite the conveyance belt 53 via the fixing belt 41.

With this configuration of the fixing device 20Y, similar to the fixing devices described above, the controller 6 depicted in FIG. 2 controls the exciting coil unit 25 to change the density of a magnetic flux applied therefrom to the first heat generation layer 41*a* of the fixing belt 41, thus switching between the first heating state in which the exciting coil unit 25 heats only the first heat generation layer 41*a* of the fixing belt 41 and the second heating state in which the exciting coil unit 25 heats both the first heat generation layer 41*a* of the fixing belt 41 and the second heat generation layer 53*a* of the conveyance belt 53.

The fixing devices 20X and 20Y may be installed with a mechanism that moves the heat generator, that is, the pressing roller 31 and the conveyance belt 53, with respect to the fixing rotary body, that is, the fixing belts 21 and 41, like the heat generator separator 70 depicted in FIGS. 8A and 8B, the heat generator moving assembly 71 depicted in FIG. 9, and the heat generator moving assembly 72 depicted in FIG. 12. Further, the heat generator of the fixing devices 20X and 20Y may be installed with one or more nonconductive portions such as the slit 23Va depicted in FIG. 12, the first slits 23Va1 and the second slits 23Va2 depicted in FIG. 13A, the slits 23*a*11 depicted in FIG. 15, and the slits 23*a*12 depicted in FIG. 16A.

As described above, the fixing devices 20X and 20Y according to the fifth and sixth illustrative embodiments change the density of a magnetic flux applied from the exciting coil unit 25 to the first heat generation layers 21*a* and 41*a* of the fixing belts 21 and 41, switching between the first heating state in which the exciting coil unit 25 heats only the first heat generation layers 21*a* and 41*a* of the fixing belts 21 and 41 by electromagnetic induction, thus heating the fixing belts 21 and 41 and the second heating state in which the exciting coil unit 25 heats both the first heat generation layers 21*a* and 41*a* of the fixing belts 21 and 41 and the second heat generation layers 31*a* and 53*a* of the pressing roller 31 and the conveyance belt 53 by electromagnetic induction, thus heating the fixing belts 21 and 41 directly and at the same time heating the fixing belts 21 and 41 indirectly via the pressing roller 31 and the conveyance belt 53. Accordingly, the fixing belts 21 and 41 are heated to the desired fixing temperature by electromagnetic induction with improved heating efficiency within a shortened period of time.

According to the above-described exemplary embodiments, the fixing belts 21 and 41 are used as a fixing rotary body that rotates in the predetermined direction of rotation; the pressing roller 31 is used as a pressing rotary body disposed opposite the fixing rotary body to form the fixing nip N therebetween and rotating in the direction counter to the direction of rotation of the fixing rotary body. Alternatively, a fixing film, a fixing roller, or the like may be used as a fixing rotary body; a pressing belt or the like may be used as a pressing rotary body, attaining advantages equivalent to those of the fixing devices according to the above-described exemplary embodiments.

Further, according to the above-described exemplary embodiments, each of the fixing devices is installed in the monochrome image forming apparatus 1 (depicted in FIG. 1) for forming a monochrome toner image. Alternatively, each of the fixing devices may be installed in a color image forming apparatus for forming a color toner image.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a fixing rotary body to rotate in a predetermined direction of rotation, including a first heat generation layer;

a pressing rotary body disposed parallel to and pressed against the fixing rotary body to form a fixing nip therebetween through which a recording medium bearing a toner image is conveyed;

a heat generator to heat the fixing rotary body to a predetermined target temperature, separably contacting the fixing rotary body and including a second heat generation layer;

a first exciting coil to generate a magnetic flux, disposed opposite the heat generator via the fixing rotary body in a first region;

a second exciting coil to generate a magnetic flux, disposed opposite the heat generator via the fixing rotary body in a second region sandwiching the first region in the direction of rotation of the fixing rotary body;

an alternating electric current power supply connectable to the first exciting coil and the second exciting coil; and a switch circuit connected to the first exciting coil, the second exciting coil, and the alternating electric current power supply to selectively connect the alternating electric current power supply to the first exciting coil and the second exciting coil, wherein when the switch circuit connects the alternating electric current power supply to both the first exciting coil and the second exciting coil, the first exciting coil and the second exciting coil together generate a first magnetic flux having a first density that reaches only the first heat generation layer of the fixing rotary body, and wherein when the switch circuit connects the alternating electric current power supply to the first exciting coil only, the first exciting coil generates a second magnetic flux having a second density greater than the first density that reaches both the first heat generation layer of the fixing rotary body and the second heat generation layer of the heat generator.

2. The fixing device according to claim 1, wherein a saturation magnetic flux density of the first heat generation layer of the fixing rotary body is greater than the first density of the first magnetic flux and smaller than the second density of the second magnetic flux.

3. The fixing device according to claim 1, wherein the switch circuit connects the alternating electric current power supply to both the first exciting coil and the second exciting coil while the fixing device is warmed up.

4. The fixing device according to claim 1, wherein the switch circuit connects the alternating electric current power supply to the first exciting coil only when a plurality of recording media is conveyed through the fixing nip continuously.

5. The fixing device according to claim 1, further comprising a heat generator separator operatively connected to the heat generator to separate the heat generator from the fixing rotary body.

6. The fixing device according to claim 5, wherein the heat generator separator separates the heat generator from the fixing rotary body while the fixing device is warmed up.

7. The fixing device according to claim 5, wherein the heat generator separator separates the heat generator from the fixing rotary body when the toner image on the recording medium is a monochrome toner image.

8. The fixing device according to claim 5, wherein the heat generator separator separates the heat generator from the fixing rotary body when the recording medium has a thickness not greater than a predetermined thickness.

9. The fixing device according to claim 5, wherein the heat generator separator separates the heat generator from the fixing rotary body when the predetermined target temperature of the fixing rotary body is relatively low.

10. The fixing device according to claim 5, further comprising a temperature detector disposed opposite the fixing rotary body to detect a temperature of the fixing rotary body, wherein the heat generator separator separates the heat generator from the fixing rotary body when the temperature detector detects that the temperature of the fixing rotary body is higher than the predetermined target temperature while the heat generator contacts the fixing rotary body.

11. The fixing device according to claim 5, further comprising a temperature detector disposed opposite the fixing rotary body to detect a temperature of the fixing rotary body, wherein the heat generator separator causes the heat generator to contact the fixing rotary body when the temperature detector detects that the temperature of the fixing rotary body is higher than the predetermined target temperature while the heat generator is isolated from the fixing rotary body.

12. The fixing device according to claim 5, wherein the heat generator separator separates the heat generator from the fixing rotary body when the recording medium is conveyed through the fixing nip at a relatively low speed.

13. The fixing device according to claim 5, wherein the heat generator includes:

a center portion disposed at a center of the heat generator in an axial direction of the fixing rotary body;

a first lateral end portion disposed at one lateral end of the heat generator in the axial direction of the fixing rotary body; and a second lateral end portion disposed at another lateral end of the heat generator in the axial direction of the fixing rotary body, wherein the heat generator separator separates the center portion of the heat generator when the recording medium has a width in the axial direction of the fixing rotary body not greater than a predetermined width and the heat generator separator separates the center portion, the first lateral end portion, and the second lateral end portion of the heat generator when the recording medium has a width in the axial direction of the fixing rotary body greater than the predetermined width.

14. The fixing device according to claim 5, further comprising a first heat generator moving assembly operatively connected to the heat generator to rotate the heat generator in a circumferential direction of the fixing rotary body between an opposed position where the heat generator is disposed opposite the first exciting coil and the second exciting coil and a non-opposed position where the heat generator is not disposed opposite the first exciting coil and the second exciting coil.

15. The fixing device according to claim 1, further comprising a second heat generator moving assembly operatively connected to the heat generator to rotate the heat generator in a circumferential direction of the fixing rotary body, wherein the heat generator includes a nonconductive portion extending in a passing direction of an eddy current induced to the second heat generation layer of the heat generator, and wherein the second heat generator moving assembly rotates the heat generator between an opposed position where the nonconductive portion of the heat generator is disposed opposite the first exciting coil and the second exciting coil and a non-opposed position where the nonconductive portion of the heat generator is not disposed opposite the first exciting coil and the second exciting coil.

16. The fixing device according to claim 1, further comprising a second heat generator moving assembly operatively connected to the heat generator to rotate the heat generator in a circumferential direction of the fixing rotary body, wherein the heat generator includes:

a first nonconductive portion extending in a passing direction of an eddy current induced to the second heat generation layer of the heat generator throughout a long width of the heat generator in the axial direction of the fixing rotary body; and a second nonconductive portion disposed at lateral ends of the heat generator in the axial direction of the fixing rotary body and extending in a passing direction of an eddy current induced to the second heat generation layer of the heat generator, wherein the second heat generator moving assembly rotates the heat generator to a first opposed position where the first nonconductive portion of the heat generator is disposed opposite the first exciting coil and the second exciting coil when the recording medium has a width in the axial direction of the fixing rotary body greater than a predetermined width, and wherein the second heat generator moving assembly rotates the heat generator to a second opposed position where the second nonconductive portion of the heat generator is disposed opposite the first exciting coil and the second exciting coil when the recording medium has a width in the axial direction of the fixing rotary body not greater than the predetermined width.

17. The fixing device according to claim 1, wherein the heat generator includes a nonconductive portion extending in a direction orthogonal to a passing direction of an eddy current induced to the second heat generation layer of the heat generator.

18. The fixing device according to claim 17, wherein the nonconductive portion is disposed at lateral ends of the heat generator in the axial direction of the fixing rotary body.

19. A fixing device comprising:

a fixing rotary body to rotate in a predetermined direction of rotation, including a first heat generation layer;

a pressing rotary body disposed parallel to and pressed against the fixing rotary body to form a fixing nip therebetween through which a recording medium bearing a toner image is conveyed, the pressing rotary body including a second heat generation layer to heat the fixing rotary body to a predetermined target temperature;

a first exciting coil to generate a magnetic flux, disposed opposite the pressing rotary body via the fixing rotary body in a first region;

a second exciting coil to generate a magnetic flux, disposed opposite the pressing rotary body via the fixing rotary body in a second region sandwiching the first region in the direction of rotation of the fixing rotary body;

an alternating electric current power supply connectable to the first exciting coil and the second exciting coil; and a switch circuit connected to the first exciting coil, the second exciting coil, and the alternating electric current power supply to selectively connect the alternating electric current power supply to the first exciting coil and the second exciting coil, wherein when the switch circuit connects the alternating electric current power supply to both the first exciting coil and the second exciting coil, the first exciting coil and the second exciting coil together generate a first magnetic flux having a first density that reaches only the first heat generation layer of the fixing rotary body; and wherein when the switch circuit connects the alternating electric current power supply to the first exciting coil only, the first exciting coil generates a second magnetic flux having a second density greater than the first density that reaches both the first heat generation layer of the fixing rotary body and the second heat generation layer of the pressing rotary body.

20. An image forming apparatus comprising the fixing device according to claim 1.

* * * * *